US005592923A

United States Patent [19]

Machida

[11] Patent Number: 5,592,923

[45] Date of Patent: Jan. 14, 1997

[54] DIAGNOSIS APPARATUS AND METHOD IN AN APPARATUS FOR TREATING FUEL VAPOR OF AN ENGINE

[75] Inventor: Kenichi Machida, Atsugi, Japan

[73] Assignee: Unisia Jecs Corporation, Kanagawa-ken, Japan

[21] Appl. No.: 513,284

[22] Filed: Aug. 10, 1995

[30] Foreign Application Priority Data

Aug. 11, 1994 [JP] Japan ..... 6-189213

[51] Int. Cl.[6] ..... F02M 33/02

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 5,193,511 | 4/1993 | Fujino | 123/520 |
| 5,211,151 | 5/1993 | Nakajima et al. | 123/520 |
| 5,299,545 | 4/1994 | Kuroda et al. | 123/520 |
| 5,333,589 | 8/1994 | Otsuka | 123/520 |
| 5,345,917 | 9/1994 | Maruyama et al. | 123/520 |
| 5,355,863 | 10/1994 | Yamanaka et al. | 123/520 |
| 5,355,864 | 10/1994 | Kuroda et al. | 123/520 |
| 5,363,828 | 11/1994 | Yamashita et al. | 123/520 |
| 5,383,438 | 1/1995 | Blumenstock | 123/520 |
| 5,396,873 | 3/1995 | Yamanaka et al. | 123/520 |
| 5,398,662 | 3/1995 | Igarashi et al. | 123/520 |
| 5,427,075 | 6/1995 | Yamanaka et al. | 123/520 |
| 5,441,031 | 8/1995 | Kiyomiya et al. | 123/520 |
| 5,448,980 | 9/1995 | Kawamura et al. | 123/520 |

FOREIGN PATENT DOCUMENTS 62-7962 1/1987 Japan .

*Primary Examiner*—Thomas N. Moulis

*Attorney, Agent, or Firm*— Lowe, Price, LeBlanc & Becker

[57] ABSTRACT

In an apparatus for treating fuel vapor, in which the fuel vapor in a fuel tank is once adsorbed and trapped in a canister and is then supplied to the intake system of an engine, wherein various valves are so controlled that a predetermined pressure condition is established in a passage for supplying the fuel vapor, and said various valves are diagnosed whether they are defective or not based upon that the practical pressure is becoming as expected or not.

18 Claims, 23 Drawing Sheets

DIAGNOSIS APPARATUS AND METHOD IN AN APPARATUS FOR TREATING FUEL VAPOR OF AN ENGINE

FIELD OF THE INVENTION

The present invention relates to a diagnosis apparatus and method in an apparatus for treating fuel vapor in an engine. More specifically, the invention relates to technology for diagnosing defects in an apparatus which supplies fuel vapor in a fuel tank to an intake system of an engine to treat it.

RELATED ART OF THE INVENTION

Heretofore systems for preventing fuel vapor inside a fuel tank from diffusing into the atmosphere (refer to Japanese Unexamined Patent Publication No. 62-7962) have been proposed. According to these systems, the fuel vapor produced inside the fuel tank is temporarily adsorbed and trapped in a canister (adsorbing means), and the fuel vapor adsorbed and trapped in the canister is purged and intaken to an intake system of an engine together with the fresh air utilizing the intake negative pressure of the engine and is supplied to the intake system of the engine.

In the above-mentioned fuel vapor processor, valves that are electrically opened and closed are provided in a fuel vapor passage leading from the fuel tank to the canister and in a purge passage connected between the canister and the intake system of the engine, so that the fuel vapor is properly treated by controlling these valves.

Therefore, in case such trouble as locking of the valves at open positions or at closed positions occurs, the fuel vapor is no longer properly treated, and the operating condition of the engine and exhaust condition are deteriorated. For instance, if a valve that is provided in the purge passage to control the purge air amount is locked at the open position, the rate of purge becomes greater than a required amount of control, and a large amount of purge air is supplied to the engine causing the air-fuel ratio to become rich.

SUMMARY OF THE INVENTION

In view of the above-mentioned problem, an object of the present invention is to provide a diagnosis apparatus and method capable of diagnosing troubles of various valves constituting an apparatus for treating fuel vapor.

In order to accomplish the above-mentioned object, with the diagnosis apparatus and method according to the present invention, in an apparatus for treating vapor of an engine, in which the fuel vapor in a fuel tank is adsorbed and trapped by an adsorbing means via a fuel vapor passage, and the fuel vapor adsorbed and trapped by the adsorbing means is supplied, via a purge passage, to an intake system of the engine together with the fresh air introduced through an air introduction passage utilizing an intake negative pressure of the engine, includes a check valve provided in the fuel vapor passage, a check valve by-pass valve and a drain cut valve provided in a by-pass passage which by-passes the check valve and in the air introduction passage, respectively, a purge valve interposed in the purge passage and a pressure detecting means provided to detect pressure in the fuel vapor supply passage between the purge valve, and the check valve and the check valve by-pass valve, and is constructed so that defect diagnosis is carried out for each of the valves based upon the comparison of a reference pressure conditions depending on combinations of the open and close conditions of the respective valves with a pressure detected by the pressure detecting means.

According to this construction, when the pressure condition is not as expected from the open and close conditions of the respective valves, then it is diagnosed that a desired pressure condition has not been accomplished due, for example, to the fact that a valve that should have been controlled to open is locked at a closed position.

According to the present invention, furthermore, the pressure detecting means is judged to be defective when the pressure detected by the pressure detecting means does not correspond to the atmospheric pressure in a state where the check valve by-pass valve and the purge valve are closed and the drain cut valve is opened and defect diagnosis is carried out for each of the valves after it is judged with such a defect judgement that the pressure detecting means is not defective.

Defect diagnosis for the valves is carried out based upon the results of pressure detection. When the pressure is not properly detected, therefore, defect diagnosis is not properly accomplished for all of the valves. Accordingly, it is confirmed that the pressure detection is normal depending on whether the atmospheric pressure is actually detected in a state where the atmospheric pressure is introduced and, then, defect diagnosis is carried out for each of the valves.

Here, when the purge valve consists of a purge cut valve which is opened and closed in an ON/OFF manner and a purge control valve which is interposed in series with the purge cut valve and of which opening degree is adjusted, at least either one of them is closed to establish a state in which the purge passage is closed.

Concretely, defect diagnosis for the valves is carried out as described below.

In a construction comprising the purge cut valve and the purge control valve, the purge control valve is opened to a predetermined degree in a state where the check valve by-pass valve, drain cut valve and purge cut valve are closed, and the purge cut valve is judged to be defective when the pressure detected by the pressure detecting means is equal to or smaller than the reference pressure.

In this constitution, the purge cut valve is judged to be defective when the introduction of negative pressure of the engine is recognized despite the introduction of negative pressure of the engine is inhibited by closing the purge cut valve although the purge control valve is opened to a predetermined degree.

It is further judged that the purge valve is defective when the pressure detected by the pressure detecting means is equal to or smaller than the reference pressure in a state the check valve by-pass valve is closed, the drain cut valve is opened and the purge valve is controlled to open to a predetermined opening degree.

According to this construction, it is judged that the purge valve is locked to an open position if a pressure drop greater than that which corresponds to the above-mentioned predetermined opening degree is recognized when the atmosphere is introduced and the purge valve is controlled to open to the predetermined degree.

Here, when the purge valve consists of a purge cut valve that is opened and closed in an ON/OFF manner and a purge control valve which is interposed in series with the purge cut valve and of which opening degree is adjusted, it is preferable that the state in which the purge cut valve is controlled to open and the purge control valve is controlled to open to a predetermined degree is regarded to be a state where the purge valve is controlled to open to a predetermined degree, and a valve which should be diagnosed is the purge control valve.

Moreover, the drain cut valve is judged to be defective when a pressure change detected by the pressure detecting means accompanying the opening or closing of the drain cut valve is equal to or smaller than a reference value in a state where the check valve by-pass valve is closed and the purge valve is controlled to open to a predetermined degree.

According to this construction, the pressure will change when the drain cut valve is opened and closed in a state where the negative pressure of the engine is being introduced. When no such change in the pressure is recognized, it is judged that the drain cut valve is defective.

Even in this case, when the purge valve consists of a purge cut valve that is opened and closed in an ON/OFF manner and a purge control valve which is interposed in series with the purge cut valve and of which opening degree is adjusted, it is preferable that the state where the purge cut valve is controlled to open and the purge control valve is controlled to open to a predetermined degree should be regarded to be a state where the purge valve is controlled to open to a predetermined degree.

It is further judged that the check valve by-pass valve is defective when the pressure detected by the pressure detecting means is equal to or smaller than the reference pressure despite the check valve by-pass valve is opened in a state where the purge valve and the drain cut valve are closed.

According to this construction, the check valve by-pass valve is judged to be defective when the pressure does not rise as expected in a state where after confirming the pressure of fuel vapor in the fuel tank and the check valve by-pass valve is opened to apply the pressure produced by the fuel vapor.

When the purge valve consists of a purge cut valve which is opened and closed in an ON/OFF manner and a purge control valve which is interposed in series with the purge cut valve and of which opening degree is adjusted, either one of them is closed to confine the pressure.

It is further judged that the check valve by-pass valve is defective when a deviation between a pressure detected by the pressure detecting means in a state where the drain cut valve is closed, check valve by-pass valve is opened and the purge valve is controlled to open to a predetermined degree, and a pressure detected by the pressure detecting means in a state where the drain cut valve and check valve by-pass valve are closed and the purge valve is controlled to open to a predetermined degree is equal to or smaller than the reference value.

According to this construction, it is judged that the check valve by-pass valve is not really opened or closed, and the check valve by-pass valve is judged to be defective when a deviation between a pressure in a state where the check valve by-pass valve is opened and a pressure in a state where the check valve by-pass valve is closed is equal to or smaller than a predetermined value despite the check valve by-pass valve is opened and closed in a state where the drain cut valve is closed and the purge cut valve is controlled to open to a predetermined degree.

Even in this case, when the purge valve consists of a purge cut valve which is opened and closed in an ON/OFF manner and a purge control valve which is interposed in series with the purge cut valve and of which the opening degree is adjusted, the purge valve may be controlled to open to a predetermined degree by opening the purge cut valve and controlling the purge control valve to a predetermined opening degree.

It may often happen that the defective valve is not specified. In such a case, the apparatus for treating fuel vapor is diagnosed to be defective as described below.

That is, the apparatus for treating the fuel vapor is judged to be defective when a state in which pressure detected by the pressure detecting means is equal to or greater than the reference pressure has lasted for more than a predetermined period of time in a state where the purge cut valve is judged to be not defective, the check valve by-pass valve is closed, the purge cut valve and drain cut valve are opened, and the purge control valve is controlled to open to a predetermined degree.

According to this construction, the apparatus for treating the fuel vapor is judged to be defective when a state of a high pressure has lasted for more than a predetermined period of time despite the purge cut valve is opened and the purge control valve is controlled to open to a predetermined degree to introduce the negative pressure in a state where the purge cut valve is judged to be not defective.

Moreover, the apparatus for treating the fuel vapor is judged to be defective when the pressure detected by the pressure detecting means does not approach near the atmospheric pressure within a predetermined period of time despite the purge cut valve only is closed from a state where the pressure detected by the pressure detecting means is smaller than the reference pressure in a state where the purge cut valve is judged to be not defective, the check valve by-pass valve is closed, the purge cut valve and drain cut valve are opened, and the purge control valve is controlled to open to a predetermined degree.

According to this construction, the apparatus for treating the fuel vapor is judged to be defective when the pressure does not approach near the atmospheric pressure within a predetermined period of time when the introduction of negative pressure is shut off by closing only the purge cut valve from a state where the negative pressure is acting while introducing the atmosphere in a state where the purge cut valve is judged to be not defective.

Other objects and features of the present invention will become obvious from the following description of an embodiment in conjunction with the accompanying drawings.

PREFERRED EMBODIMENT

An embodiment of the present invention will now be described.

Figure 2:
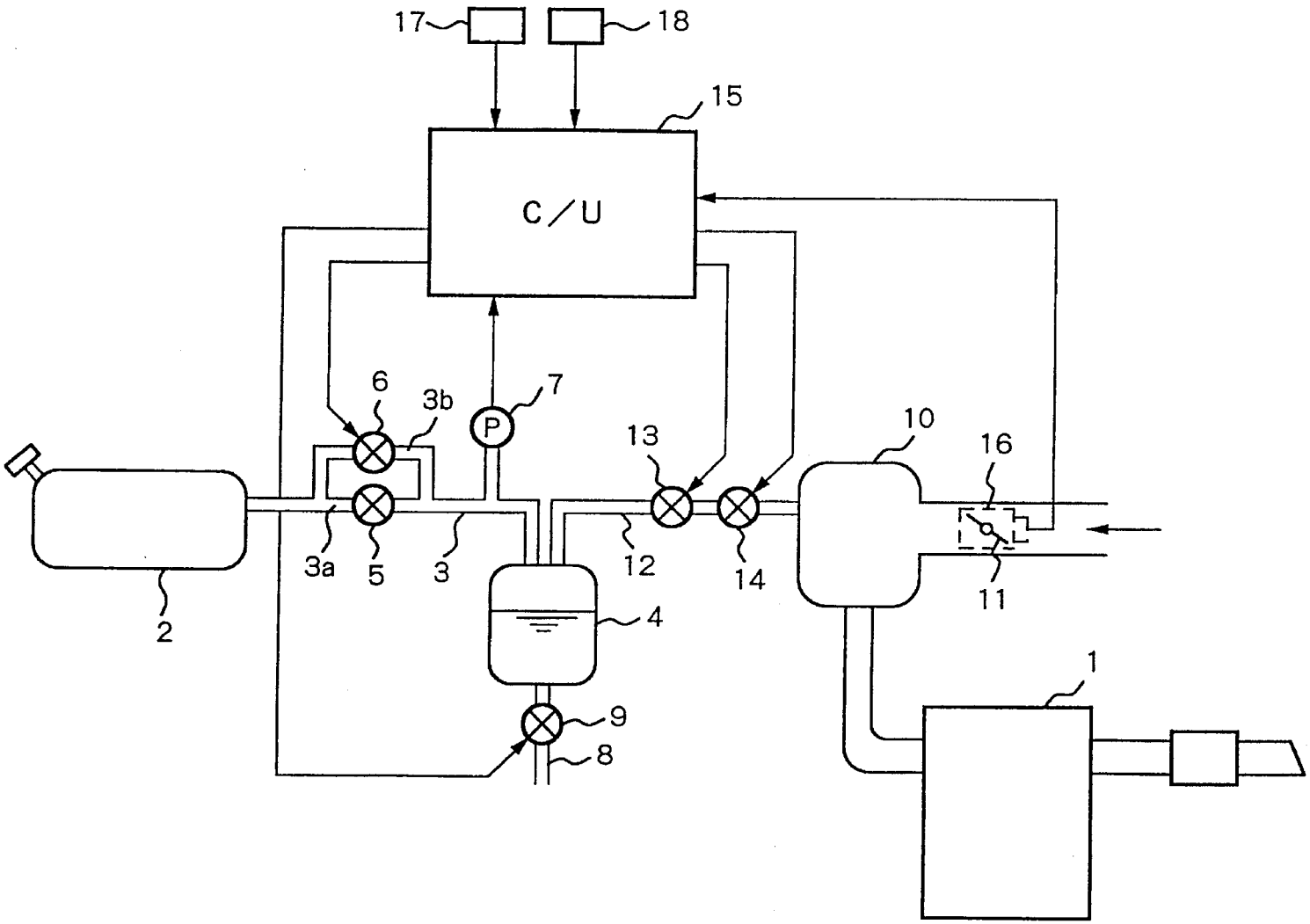
FIG. 2 is a system diagram illustrating the construction of an apparatus for treating fuel vapor according to an embodiment.

FIG. 2 is a diagram illustrating the construction of a system of an apparatus for treating fuel vapor according to the present embodiment.

Figure 1:
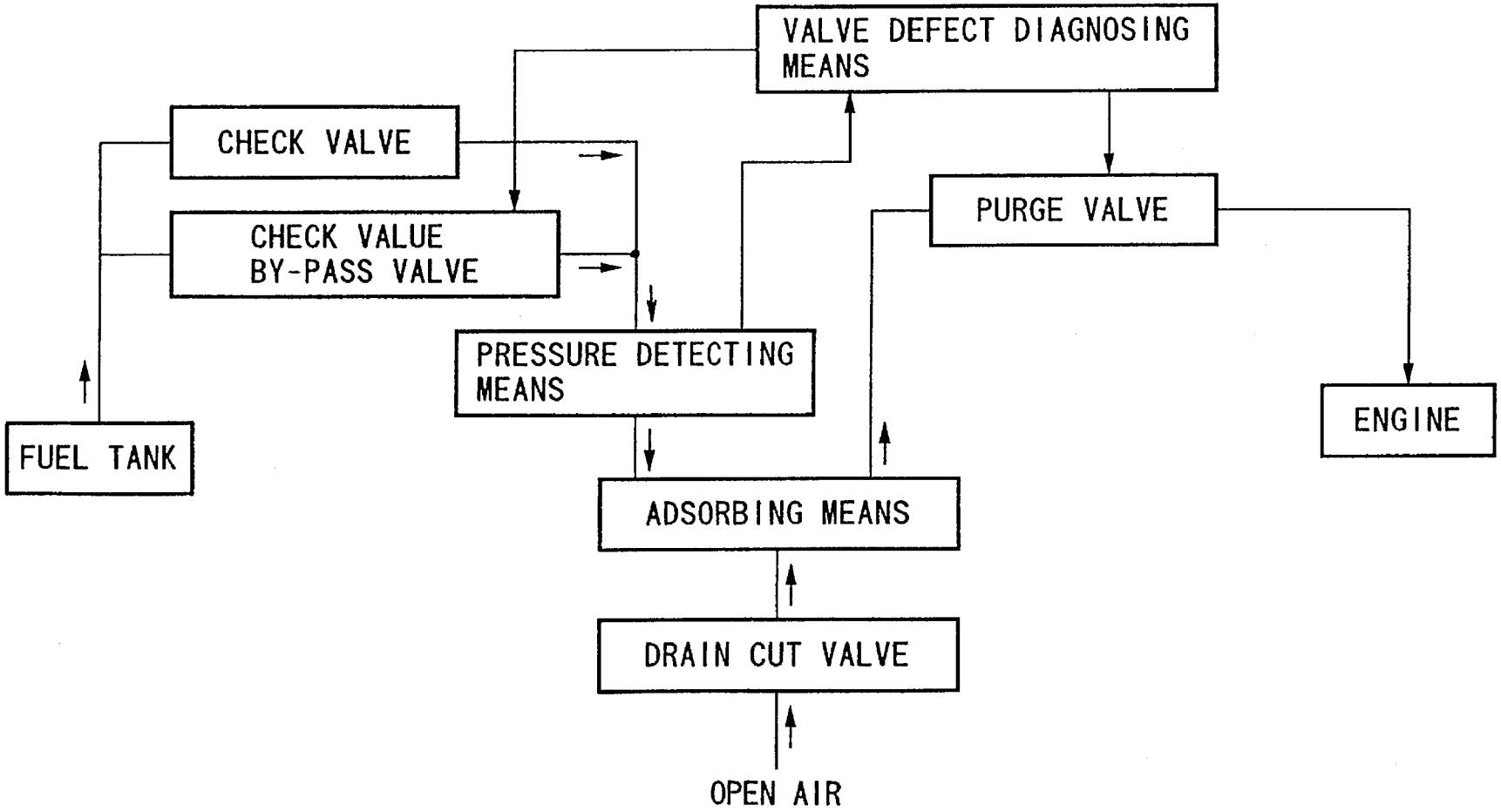
FIG. 1 is a block diagram illustrating the basic construction of a diagnosis apparatus according to the present invention.

In FIG. 2, an end of a fuel vapor passage 3 is connected to a fuel tank 2 which stores fuel that is to be supplied to an engine 1, and the other end of the fuel vapor passage 3 is connected to a canister 4 (absorbing means, see FIG. 1). The canister 4 temporarily absorbs and traps the fuel vaporized produced inside the fuel tank 2.

The fuel vapor passage 3 is branched into two which meet again in their way to the canister 4. A mechanical check valve 5 is interposed in one branched pipe 3*a*, and an electromagnetic check valve by-pass valve 6 is interposed in the other branched pipe 3*b*. In this embodiment, the pressure for opening the check valve 5 is set to be atmospheric pressure $+\alpha$ mmHg, so that the check valve 5 opens when a pressure equal to or greater than a predetermined pressure is applied.

A pressure sensor 7 (pressure detecting means, see FIG. 1) is provided in the fuel vapor passage 3 between the canister 4 and the check valve 5 and the check valve by-pass valve 6 to detect the pressure in the fuel vapor passage 3.

An air introduction passage 8 is connected to the canister 4 to introduce the fresh air, and an electromagnetic drain cut valve 9 is interposed in the air introduction passage 8 to selectively shut off the fresh air.

A purge passage 12 extends between the canister 4 and an intake collector unit 10 (intake system on the downstream side of a throttle valve 11) in the intake mainfold to supply the fuel vapor that is temporarily absorbed and trapped by the canister 4 to the intake collector 10. In the purge passage 12 are interposed an electromagnetic purge cut valve 13 and an electromagnetic purge control valve 14 in series. The purge cut valve 13 is an electromagnetic valve which opens and closes the purge passage 12 in an ON/OFF manner, and the purge control valve 14 is a flow regulating valve of which opening degree is adjusted, the purge cut valve 13 and the purge control valve 14 together constructing a purge valve (see FIG. 1).

In a state where the purge cut valve 13, purge control valve 14 and drain cut valve 9 are opened, an intake negative pressure of the engine is introduced into the canister 4 via the purge passage 12, and the fuel vapor purged from the canister 4 is intaken by the intake collector unit 10 together with the fresh air introduced into the canister 4 through the air introduction passage 8 and is burned in the engine 1.

The check valve by-pass valve 6, drain cut valve 9, purge cut valve 13 and purge control valve 14 are controlled to open and close by a control unit 15 that incorporates a microcomputer.

The control unit 15 receives a pressure detection signal from the pressure sensor 7 as well as an ON/OFF signal from an idle switch 16 which is turned on at a fully closed position (idling position) of the throttle valve 11, an intake air flow-rate detection signal Q from an air-flow meter 17 that detects the flow rate of the air intaken by the engine 1, a rotation signal from a crank angle sensor 18 that detects the crank angle of the engine 1 and the like.

The control unit 15 controls a canister purge by opening and closing the above-mentioned various valves and diagnoses the defects in the apparatus for treating fuel vapor shown in FIG. 2 in a manner as shown by the flow charts of FIGS. 3 to 5,7,9,10,12, and 14 to 17. In this embodiment, the control unit 15 is provided, in a software manner, with a function for diagnosing a valve defect (see FIG. 1), a function for diagnosing a pressure detection defect, a function for diagnosing a first system defect and a function for diagnosing a second system defect.

Figure 3:
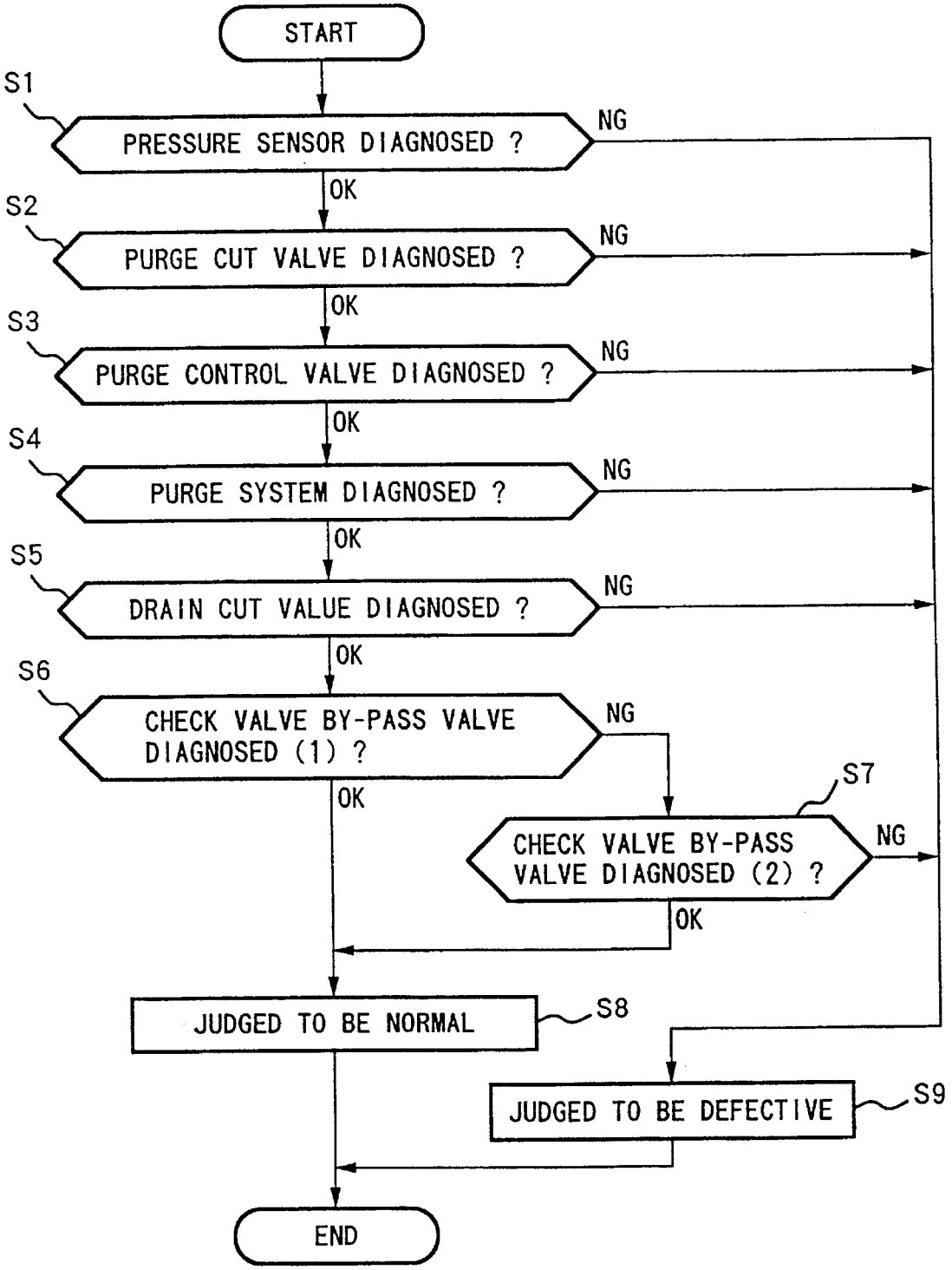
FIG. 3 is a flow chart illustrating the whole construction of diagnosis control according to the embodiment.

The flow chart of FIG. 3 illustrates the whole flow of diagnosis control according to the embodiment.

Referring to the flow chart of FIG. 3, defect diagnosis is effected in the order of the pressure sensor 7, purge cut valve 13 and purge control valve 14 (S1 to S3). When any one of them is judged to be defective, the program proceeds to step S9 where it is judged that the system of the apparatus for treating fuel vapor is defective. The program proceeds to step S4 only when diagnosis results in the above steps S1 to S3 are judged to be all normal.

The diagnosis in the step S4 cannot specify a defective portion. When the purge system is judged to be defective, the program also proceeds to step S9. When the system is judged to be normal, the program proceeds to step S5 where the drain cut valve 9 is diagnosed for its defect.

When the drain cut valve 9 is judged to be defective, step S9 judges that the apparatus is defective. When the drain cut valve 9 is judged to be normal, the program proceeds to step S6.

Step S6 executes a first diagnosis control for the check valve by-pass valve 6. When the check valve by-pass valve 6 is judged to be defective, step S7 executes a second diagnosis control. When the defective judgement is also made in the second diagnosis control of step S7, the program proceeds to step S9.

When the check valve by-pass valve 6 is judged to be normal by the first or second diagnosis, the program finally proceeds to step S8 where it is judged that the apparatus for treating fuel vapor is in the normal state.

Described below are the concrete contents of the diagnosis control in the above-mentioned steps.

Figure 4:
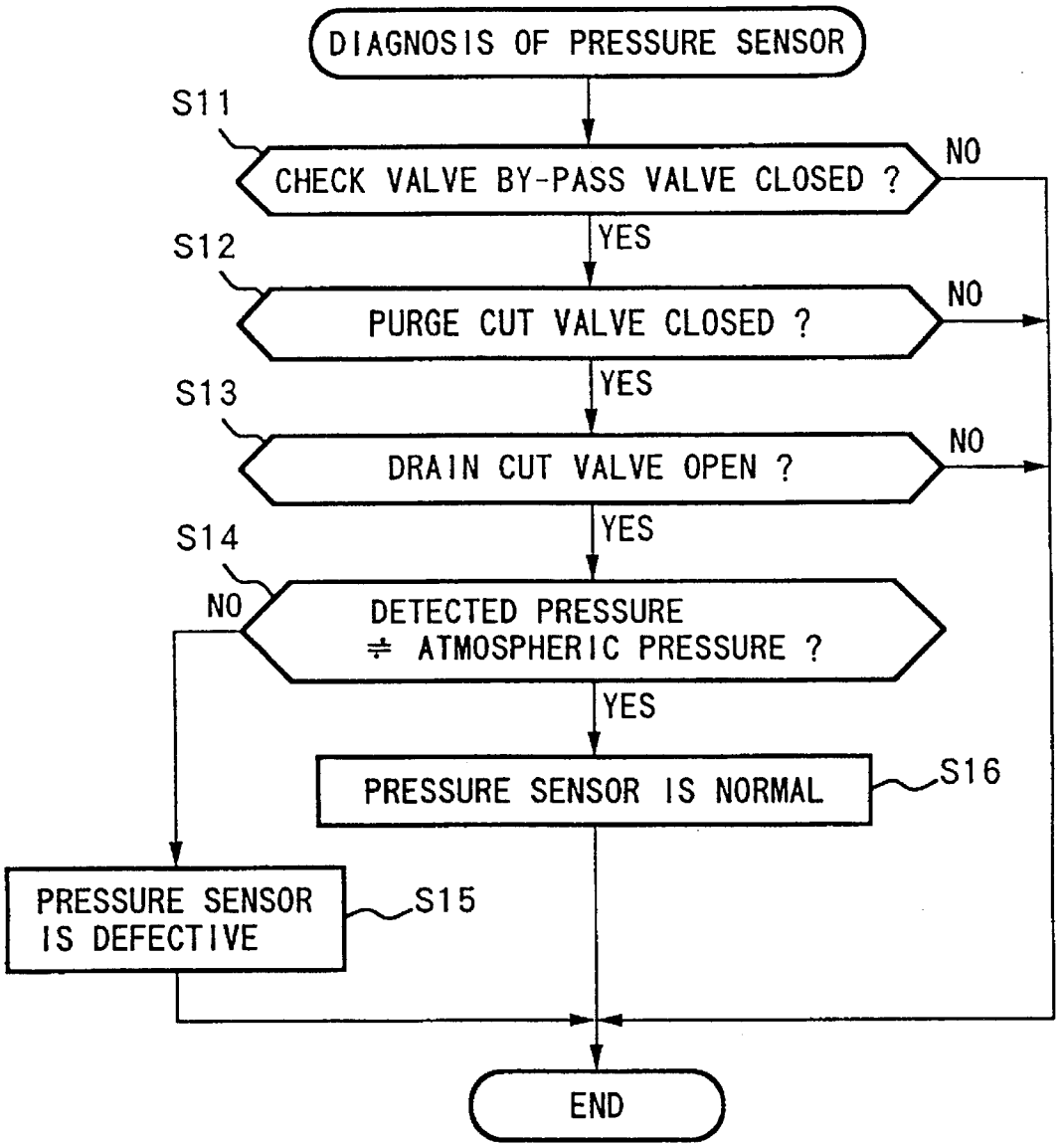
FIG. 4 is flow chart illustrating diagnosis of a pressure sensor.

Defect diagnosis of the pressure sensor 7 in step S1 (means for diagnosing defect in the pressure detection) is executed as shown in a flow chart of FIG. 4.

Referring to the flow chart of FIG. 4, it is confirmed at steps S11, S12 and S13 that the check valve by-pass valve 6 is closed, the purge cut valve 13 is closed and the drain cut valve 9 is open. In this embodiment, the confirmation of the open and closed states is regarded to show the forcible control of opening and closing of the valves for the diagnosis control. The same hereinafter holds in the following description.

When these conditions are established, the program proceeds to step S14 where it is judged whether the pressure detected by the pressure sensor 7 corresponds to the atmospheric pressure or not.

In a state where the check valve by-pass valve 6 is closed, the purge cut valve 13 is closed and the drain cut valve 9 is opened, the canister 4 is open to the open atmosphere and the pressure in a portion where the pressure sensor 7 is provided corresponds to the atmospheric pressure. When the pressure sensor 7 is normally functioning, therefore, the detected pressure will become equal to the atmospheric pressure.

When the pressure corresponding to the atmospheric pressure is not detected, therefore, it is regarded that the pressure sensor 7 may be defective, and the program proceeds to step S15 where it is judged that the pressure sensor 7 is defective. When the pressure detected by the pressure sensor 7 is approximately equal to the atmospheric pressure, it means that the pressure sensor 7 detects the pressure condition that can be estimated from the combination of the valve opening and closing. The program then proceeds to step S16 where it is judged that the pressure sensor 7 is in the normal state.

Figure 5A:
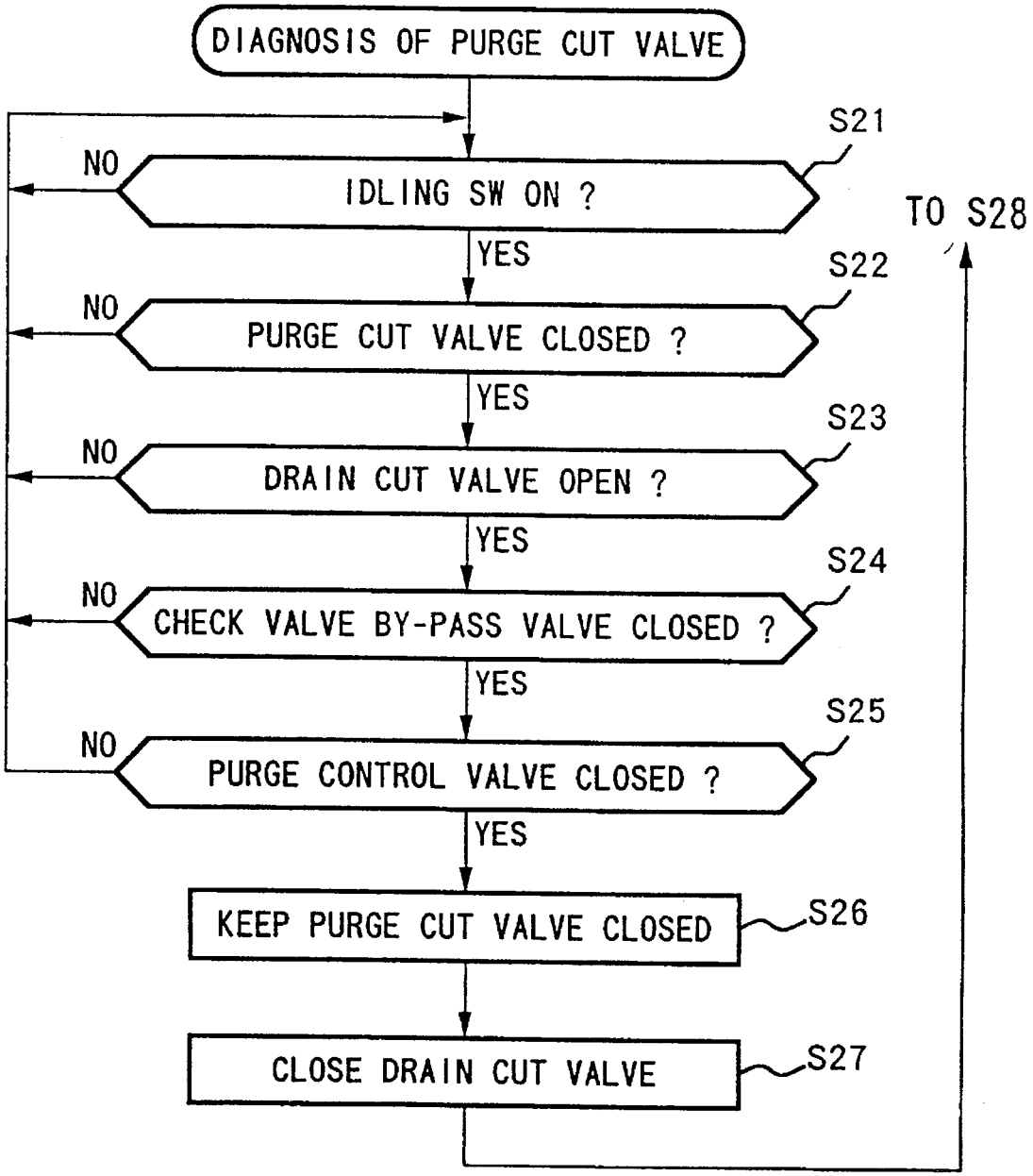
FIGS. 5A–B are a flow chart illustrating diagnosis of a purge cut valve.
Figure 5B:
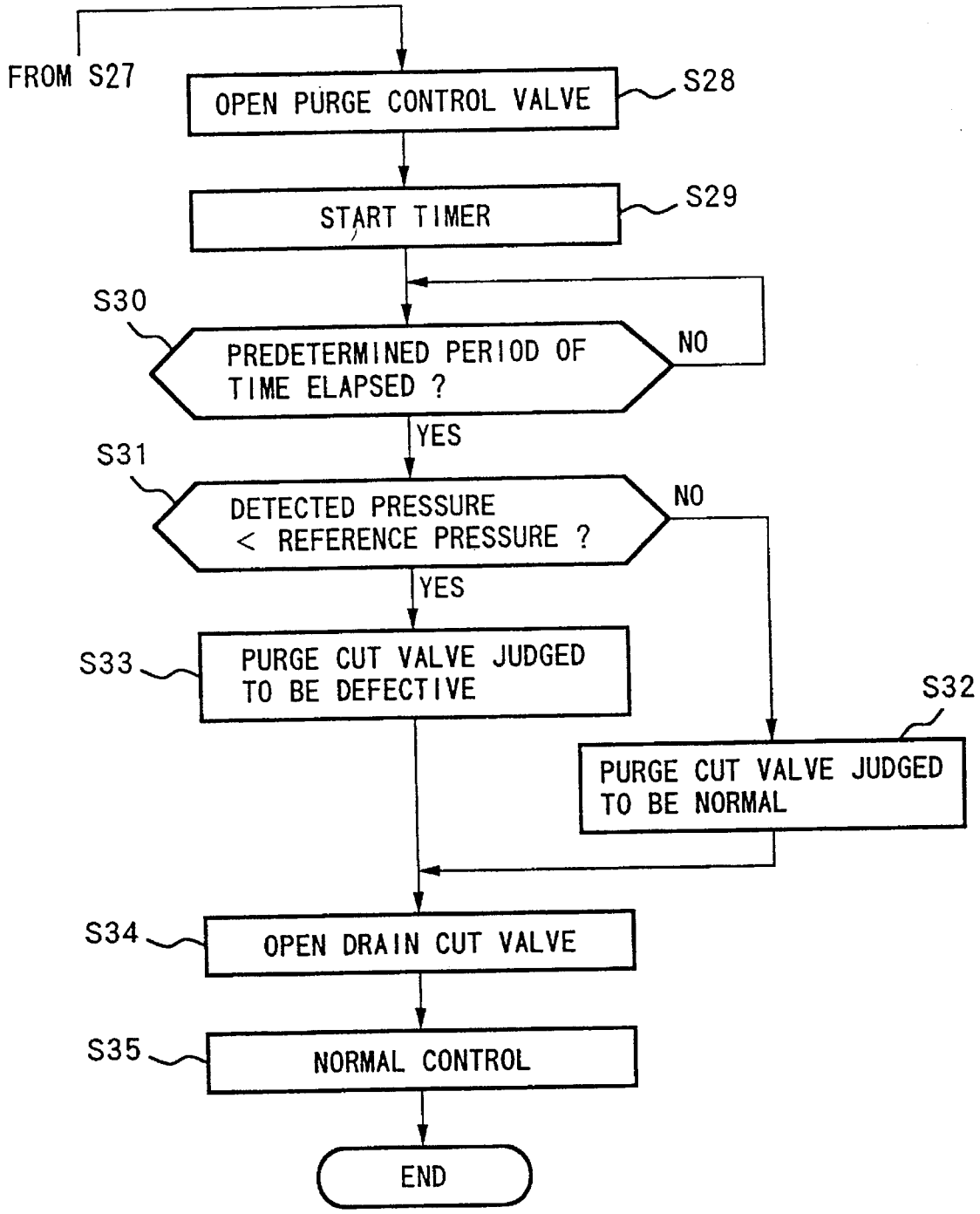

Provided that the pressure sensor 7 is judged to be in the normal state in accordance with the flow chart of FIG. 4, the purge cut valve 13 is diagnosed for its defect (S2 of flow chart of FIG. 3) in compliance with a flow chart of FIG. 5.

Referring to the flow chart of FIG. 5, it is first judged at step S21 whether the engine 1 is in the idling operation condition in which the idle switch 16 is turned on or not. In the diagnosis of the purge cut valve 13, the defect diagnosis is carried out based upon a reduction in the pressure as a result of introducing an intake negative pressure of the engine. In order to maintain precision of diagnosis accuracy by specifying the intake negative pressure condition of the engine, therefore, a state where the idle switch 16 is turned on is a prerequisite of executing the diagnosis.

When the idle switch 16 is turned on, it is confirmed at steps S22 to S25 whether the purge cut valve 13 is closed, the drain cut valve 9 is opened, the check valve by-pass valve 6 is closed and purge control valve 14 is closed. In this state, the pressure detected by the pressure sensor 7 corresponds to the atmospheric pressure.

Then, while maintaining the purge cut valve 13 in the closed state at step S26, the drain cut valve 9 is closed at step S27.

Next, the purge control valve 14 is controlled to open to a predetermined degree at step S28, and a timer is started at step S29 to measure the elapsed time from when the purge control valve 14 is opened.

At step S30, it is judged whether the elapsed time measured by the timer is equal to or longer than a predetermined period of time or not, and the program proceeds to step S31 at a moment when the predetermined period of time has passed.

Figure 6:
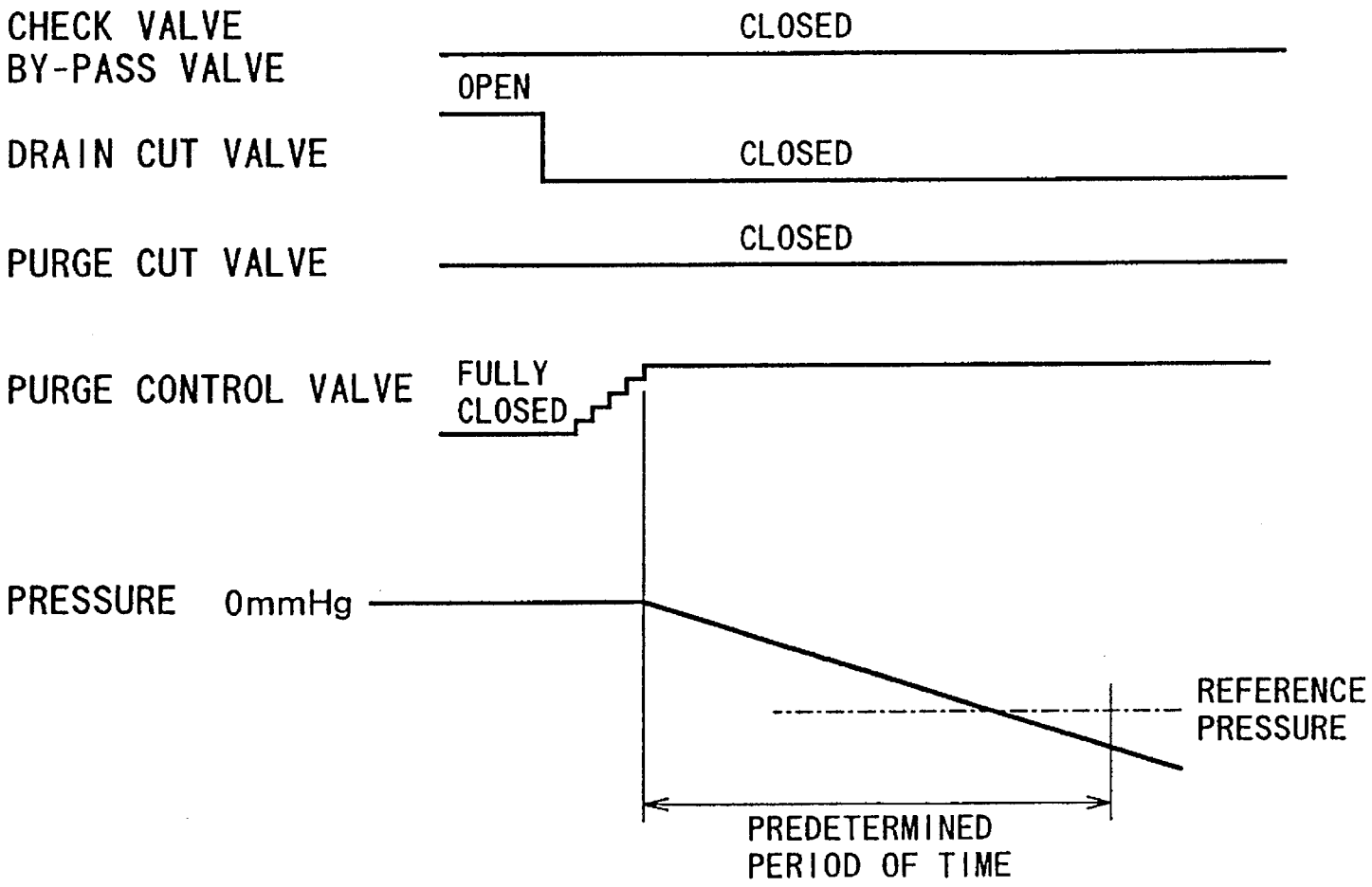
FIG. 6 is a time chart illustrating diagnostic characteristics of the purge cut valve.

At step S31, it is judged whether the pressure detected by the pressure sensor 7 is lower than reference pressure or not (see FIG. 6).

The pressure is judged in a state where the purge cut valve 13 and the drain cut valve 9 are closed. Prior to the diagnosis, furthermore, the drain cut valve 9 is closed from a state in which the drain cut valve 9 has been opened to be communicated with the open air. Therefore, if the purge cut valve 13 is normally in full-closed state, the intake negative pressure of the engine does not act even when the purge control valve 14 is opened to a predetermined degree.

In other words, when the introduction of intake negative pressure of the engine is recognized by the open control of the purge control valve 14 despite the purge cut valve 13 is controlled to close, it is presumed that since the purge cut valve 13 is locked to its open position and is remaining open despite it has been controlled to close, the intake negative pressure of the engine is introduced by the open control of the purge control valve 14.

When it is judged at step S31 that the detected pressure is lower than the predetermined pressure which represents the condition where the intake negative pressure of the engine is introduced, the program proceeds to step S33 where it is judged whether the purge cut valve 13 is locked at its open position. When the detected pressure has not been dropped to the predetermined pressure corresponding to the state of introducing the intake negative pressure at step S31, it is so regarded that the purge cut valve 13 is fully closed in response to the close control, and it is judged at step S32 that the purge cut valve 13 is normal.

When the defect diagnosis for the purge cut valve 9 is terminated, the drain cut valve 9 is returned to its open position at step S34 and the control is switched to the normal open and close control of valves at step S35.

In the flow chart of FIG. 5, the pressure level after a predetermined period of time has passed is compared with the reference pressure. It is, however, also allowable to judge that the purge cut valve 13 is defective when a difference between the pressure when the drain cut valve 9 is closed and the pressure after a predetermined period of time has passed is equal to or greater than a predetermined value. Or, the introduction of the intake negative pressure may be estimated based upon the gradient of reduction of the pressure.

Figure 7:
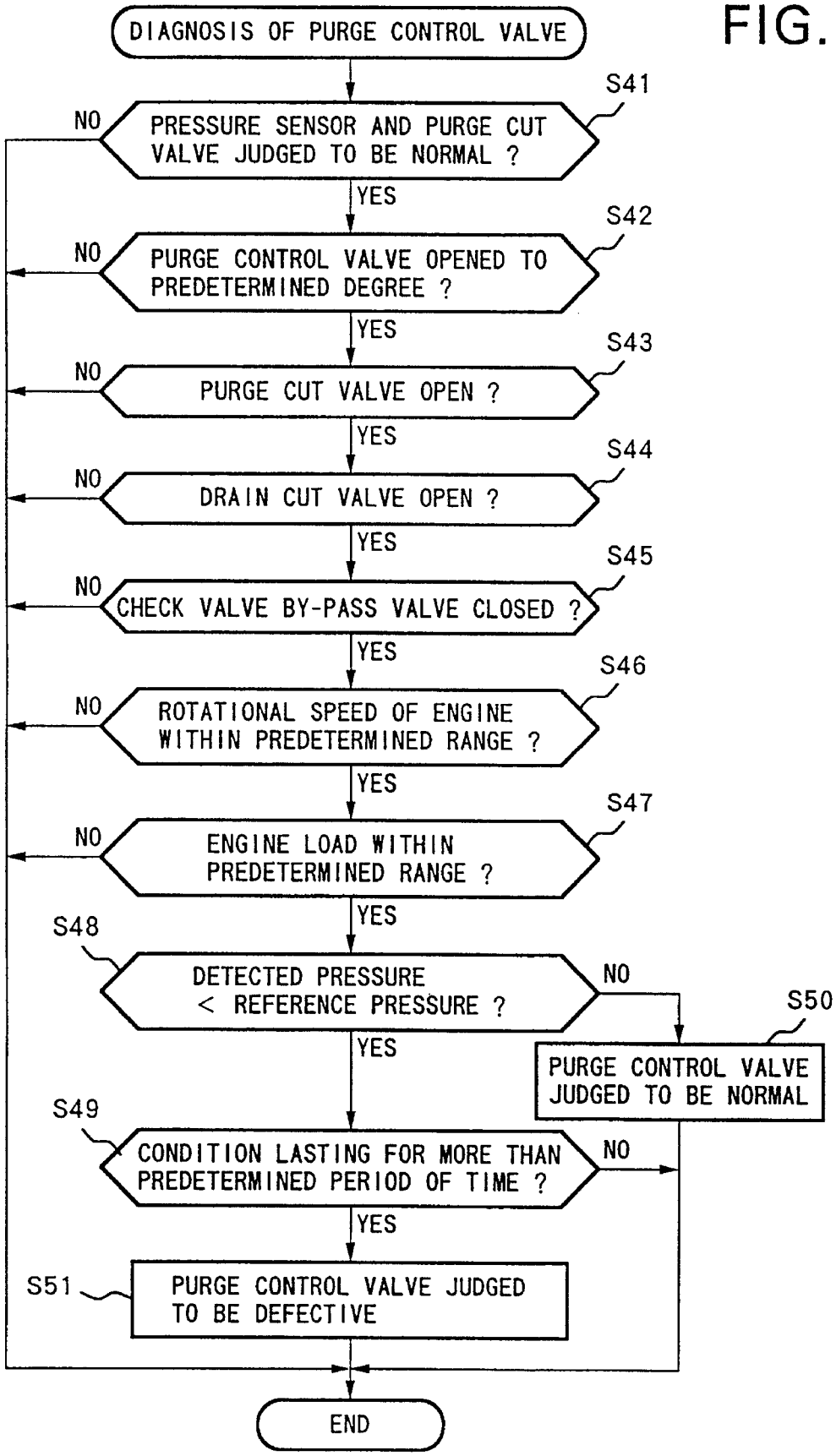
FIG. 7 is a flow chart illustrating diagnosis of a purge control valve.

When the purge cut valve 13 is diagnosed to be in the normal state as described above, then, the purge control valve 14 is diagnosed (S3 in the flow chart of FIG. 3) as explained in a flow chart of FIG. 7.

In the flow chart of FIG. 7, it is confirmed at step S41 that the pressure sensor 7 and the purge cut valve 13 have been diagnosed to be in the normal state (not in a defective state). When they have been judged to be in the normal state, the program proceeds to step S42 where it is judged whether the purge control valve 14 is controlled to open within a predetermined range or not.

When the opening degree of the purge control valve 14 is within the predetermined range, it is confirmed at steps S43 to S45 that the purge cut valve 13 is opened, the drain cut valve 9 is opened and the check valve by-pass valve 6 is closed.

When the valves are opened or closed as mentioned above, the program proceeds to step S46 where it is judged, based on a detection signal from the crank angle sensor 18, whether the rotational speed Ne of the engine is within a predetermined range or not.

When the rotational speed Ne of the engine is within the above-mentioned predetermined range, the program proceeds to step S47 where it is judged whether the load of the engine is within a predetermined range or not. In this embodiment, the load of the engine is represented by a basic injection pulse width Tp ($\leftarrow K \times Q/Ne$, K is a constant) which is calculated as a predetermined ratio of the cylinder intake air amount in an electronically-controlled fuel injection apparatus.

Figure 8:
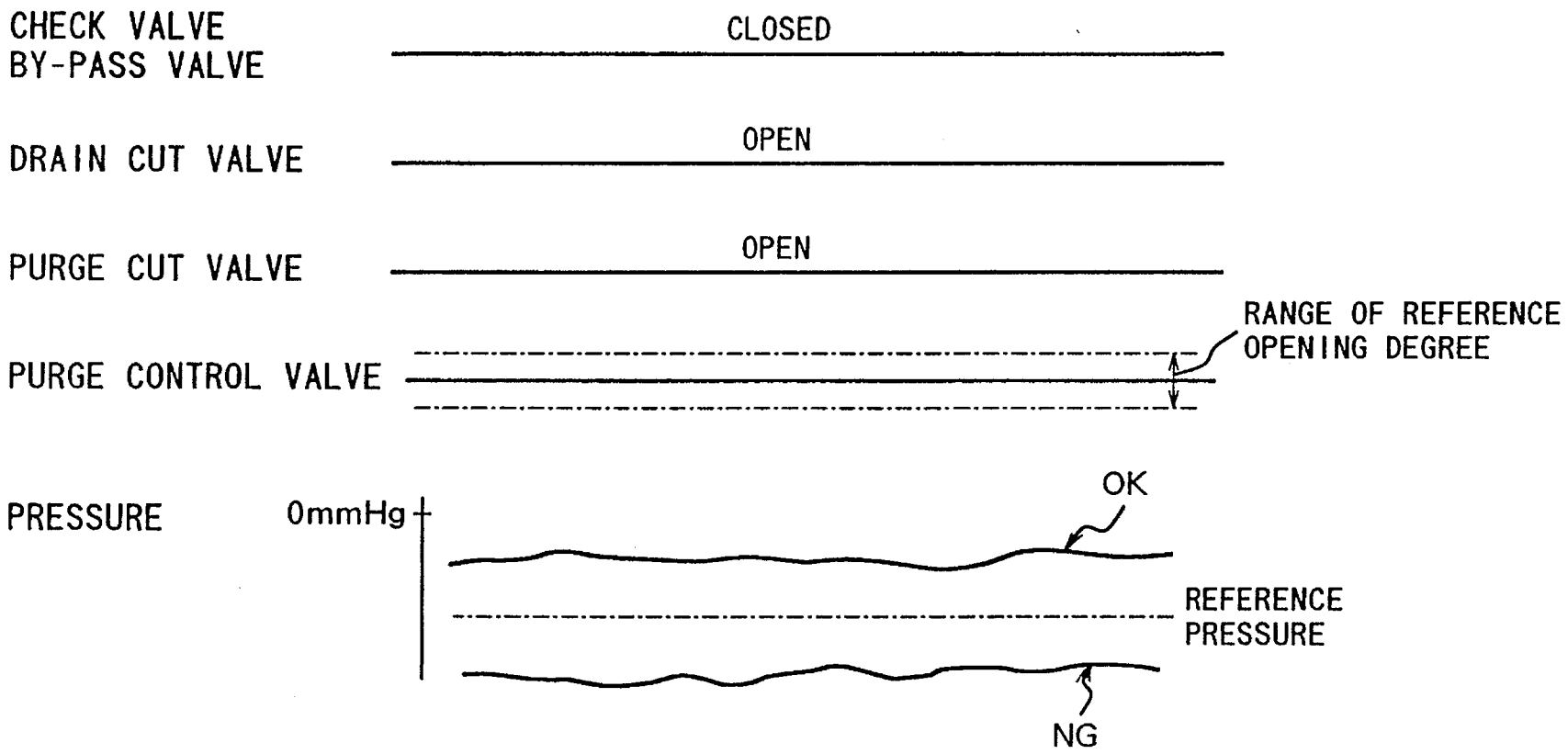
FIG. 8 is a time chart illustrating diagnostic characteristics of the purge control valve.

When it is judged that the rotational speed of the engine and the load of the engine are within predetermined ranges, as described above, the program proceeds to step S48 where it is judged whether the pressure detected by the pressure sensor 7 is smaller than the reference pressure or not (see FIG. 8).

The reference pressure has been set to be a value that will not be assumed under the conditions where the engine is operating as judged above and the purge control valve 14 is opened to a degree as mentioned above, but that will be assumed when the purge control valve 14 is locked to its open position. When the detected pressure is equal to or greater than the reference pressure at step S48, the program proceeds to step S50 where it is judged whether the purge control valve 14 is in the normal state or not.

When it is detected at step S48 that the detected pressure is lower than the reference pressure, step S49 judges the duration of such a pressure condition. When the condition in which the detected pressure is lower than the reference pressure lasts for more than a predetermined period of time, it is regarded that the pressure has dropped greatly in the fuel vapor passage since the purge control valve 14 is actually opened to a degree (inclusive of fully opened state) greater than the above-mentioned predetermined degree despite the purge control valve 14 has been controlled to open to the predetermined degree, and the program proceeds to step S51 where the purge control valve 14 is judged to be defective.

When the purge control valve 14 is diagnosed to be defective as described above, the system is then diagnosed as represented by the step S4 in the flow chart of FIG. 3.

Figure 9:
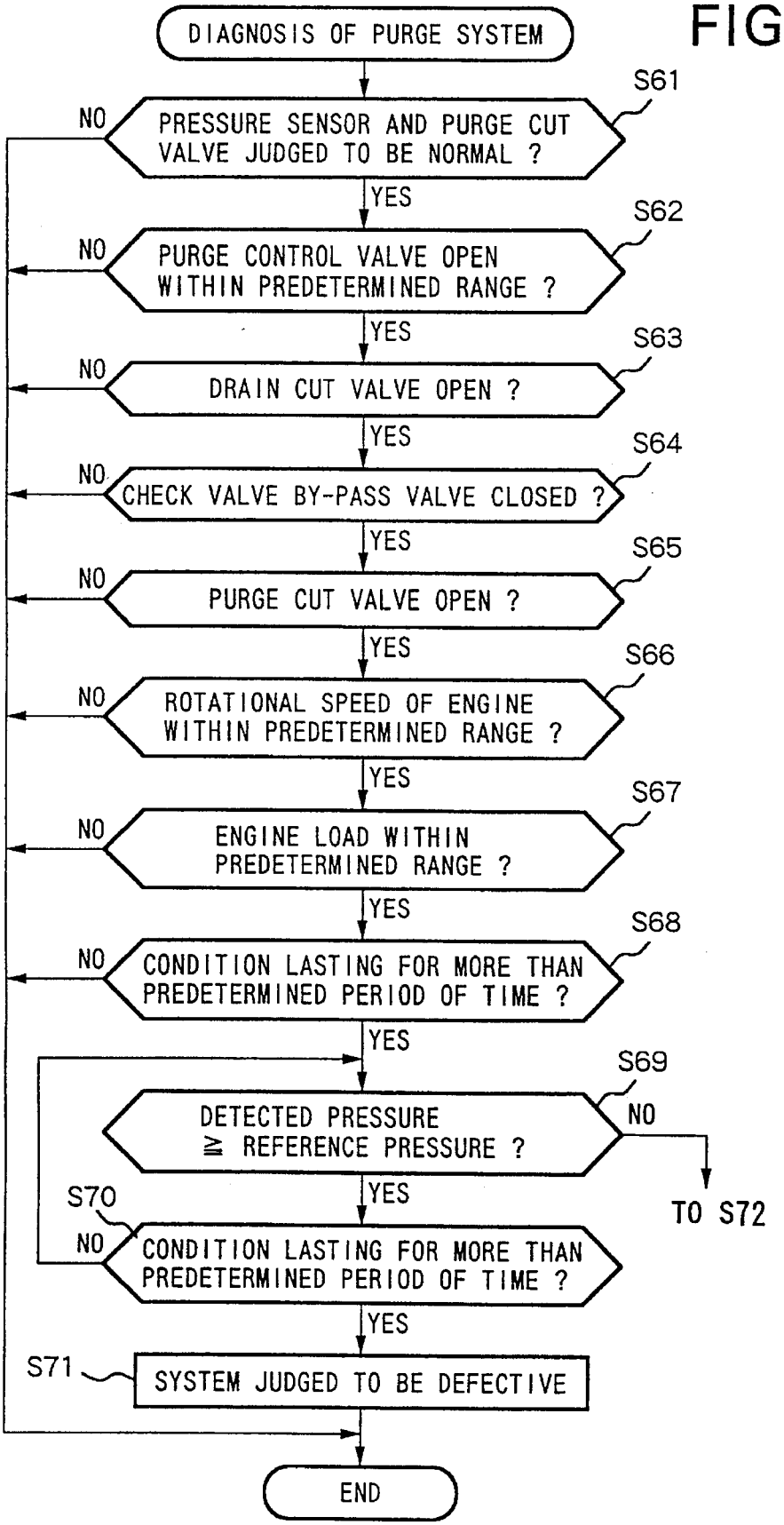
FIG. 9 is a flow chart illustrating diagnosis of a purge system.
Figure 10:
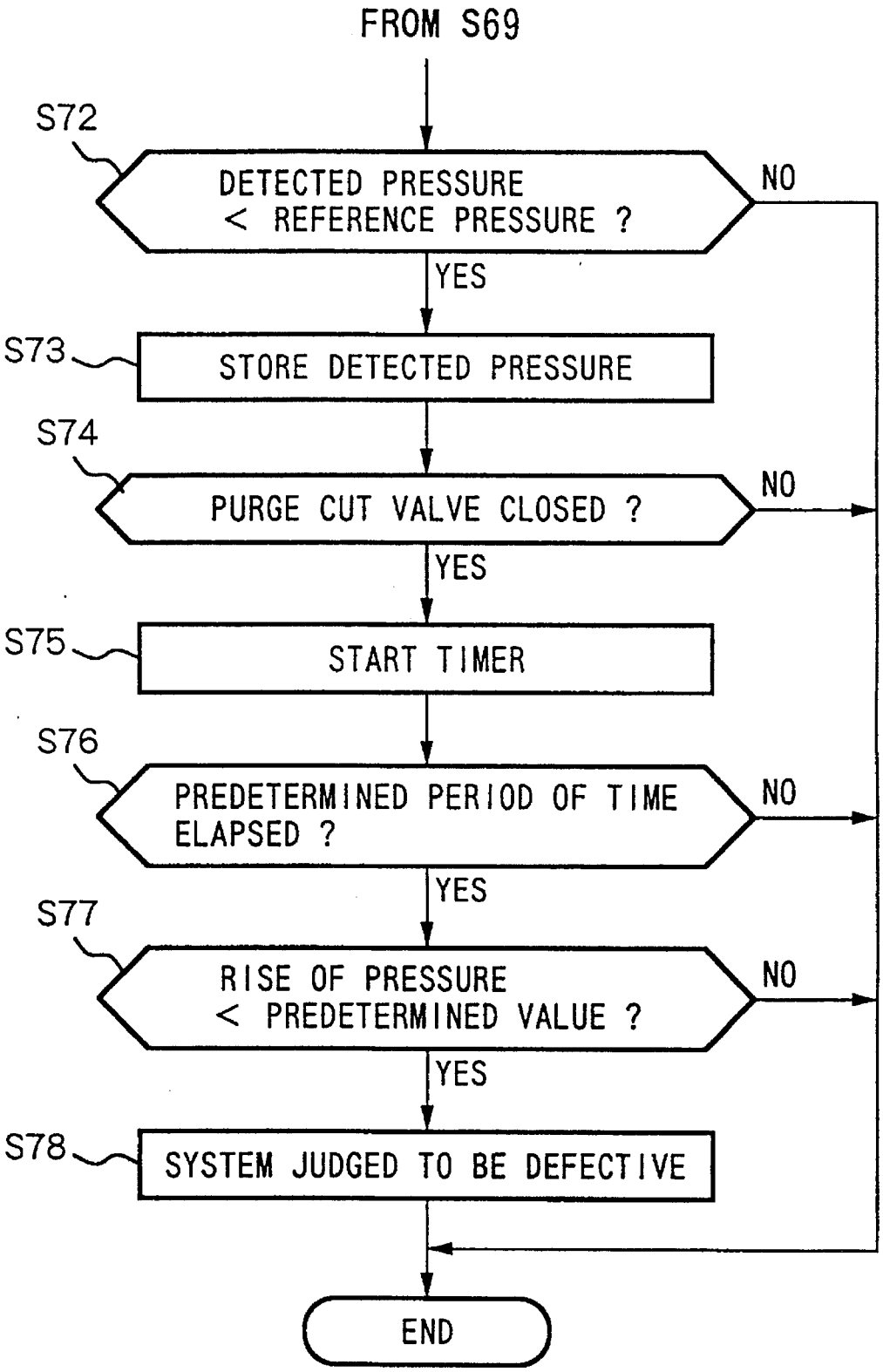
FIG. 10 is a flow chart illustrating diagnosis of the purge system continued from FIG. 9.

Details of the system diagnosis is explained in the flow charts of FIGS. 9 and 10.

In the flow charts of FIGS. 9 and 10, it is confirmed at step S61 that the pressure sensor 7 and the purge cut valve 13 have been judged to be in the normal state.

At step S62, it is judged whether the purge control valve 14 has been opened within a predetermined range or not. When it has been opened within a predetermined range, it is judged at steps S63 to S65 if the drain cut valve 9 is opened, the check valve by-pass valve 6 is closed and the purge cut valve 13 is opened.

When these valves have been opened or closed as described above, it is judged at steps S66 and S67 if the rotational speed Ne of the engine and the engine load Tp are within predetermined ranges or not.

When the rotational speed Ne of the engine and the engine load Tp are within predetermined ranges, it is judged at step S68 if the conditions of steps S62 to S67 are lasting for more than a predetermined period of time or not so as to judge if the pressure in the fuel vapor passage is stabilized in a state of introducing the intake negative pressure of the engine.

When the diagnosed condition is confirmed to be stable, the program proceeds to step S69 where it is judged whether the pressure detected by the pressure sensor 7 is equal to or greater than the reference pressure or not. A value corresponding to the atmospheric pressure has been set as the reference pressure.

In the state where the above-mentioned valves are opened or closed, since an intake negative pressure of the engine will be introduced the pressure detected by the pressure sensor 7 will become a negative pressure. When the pressure is judged to be corresponding to the atmospheric pressure at step S69, however, it can be presumed that the intake negative pressure of the engine has not been introduced due to the purge out valve 13 and the purge control valve 14 that are locked at their closed positions, or a negative pressure is not maintained in the passage due to leakage in the conduit inclusive of the pressure sensor 7.

When it is detected that the pressure detected is equal to or greater than the reference pressure (corresponding to the atmospheric pressure), it is confirmed at step S70 that such a pressure state is lasting for more than a predetermined period of time. The program then proceeds to step S71 to judge the system defect without specifying a defective portion.

On the other hand, when it is confirmed form the result of detection by the pressure sensor 7 at the step S69 that the intake negative pressure of the engine has been introduced, the program proceeds to step 72 where it is judged whether the pressure detected by the pressure sensor 7 is smaller than the reference negative pressure or not. Steps S61 to S71 correspond to means for diagnosing the first system, and step S72 and the subsequent steps correspond to means for diagnosing the second system.

When the detected pressure is smaller than the reference negative pressure, the pressure detected at that moment is stored at step S73.

Then step S74 judges whether the purge cut valve 13 is closed. After the purge cut valve 13 is closed, the program proceeds to step S75 where a timer is started to measure the lapse of time from when the purge cut valve 13 is closed.

Depending upon the measurement of time by the timer, it is judged at step S76 if a predetermined period of time has passed from when the purge cut valve 13 was closed. At a moment when the predetermined period of time has passed, the program proceeds to step S77 where it is judged whether a difference between the pressure that was detected and stored at a moment when the purge cut valve 13 was closed and the pressure detected at a present moment after the predetermined period of time has passed is smaller than a predetermined value or not.

Figure 11:
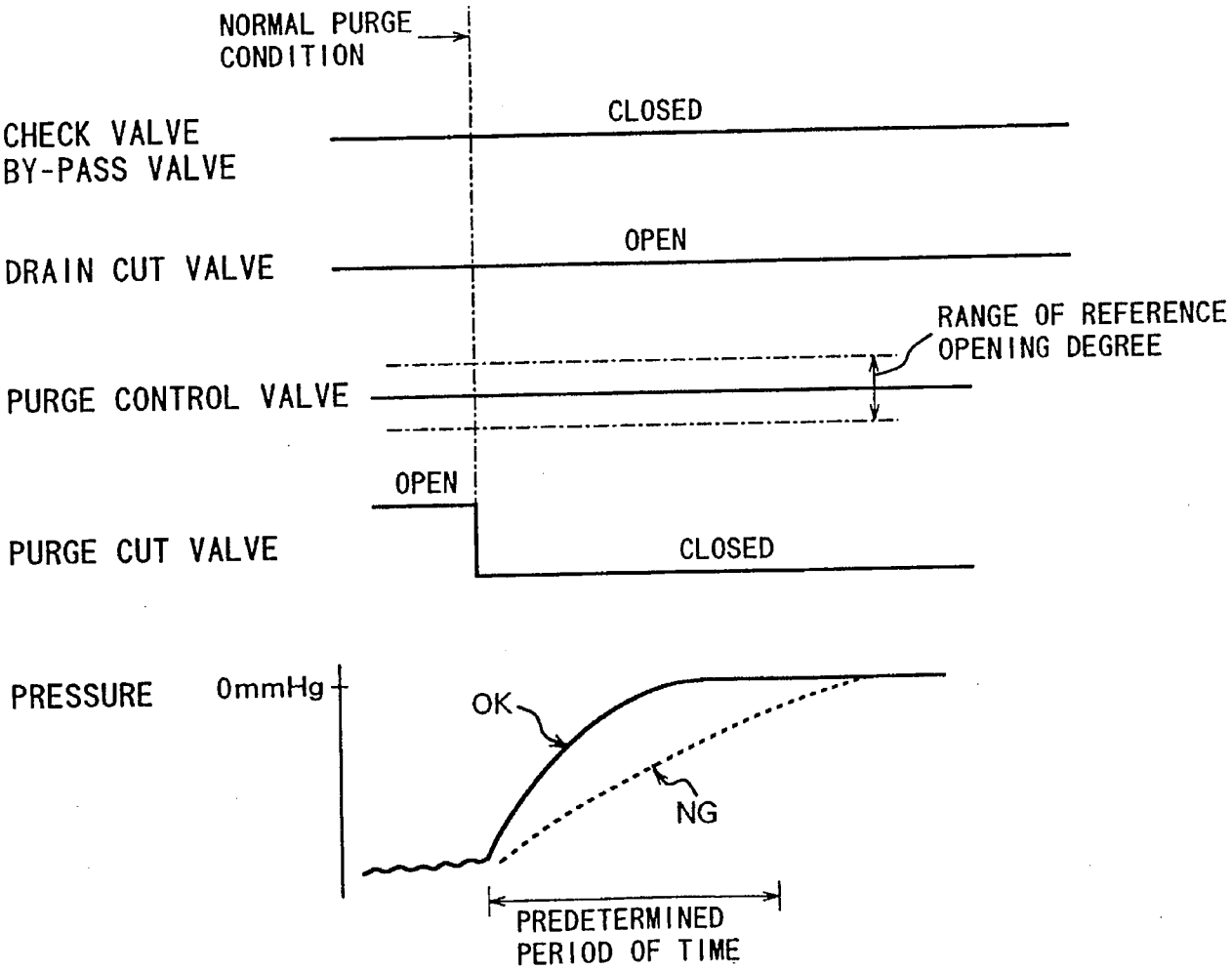
FIG. 11 is a time chart illustrating characteristics in the diagnosis of the purge system.

Due to the closure of the purge cut valve 13, introduction of the intake negative pressure of the engine is shut off, the canister 4 is opened to the atmosphere, and a time long enough for the pressure to change into a value corresponding to the atmospheric pressure has been set as the above-mentioned predetermined period of time. In the normal state, therefore, the pressure change will become greater than, at least, the difference between the reference negative pressure and the atmospheric pressure at the above-mentioned step S72 (see FIG. 11).

Therefore, when it is judged at step S77 that the pressure difference is smaller than a predetermined value, it is presumed that the pressure is not properly detected due to clogged or folded conduit of the pressure sensor 7. In this case, therefore, the program proceeds to step S78 where it is judged the system defect without specifying the defective portion.

Figure 12A:
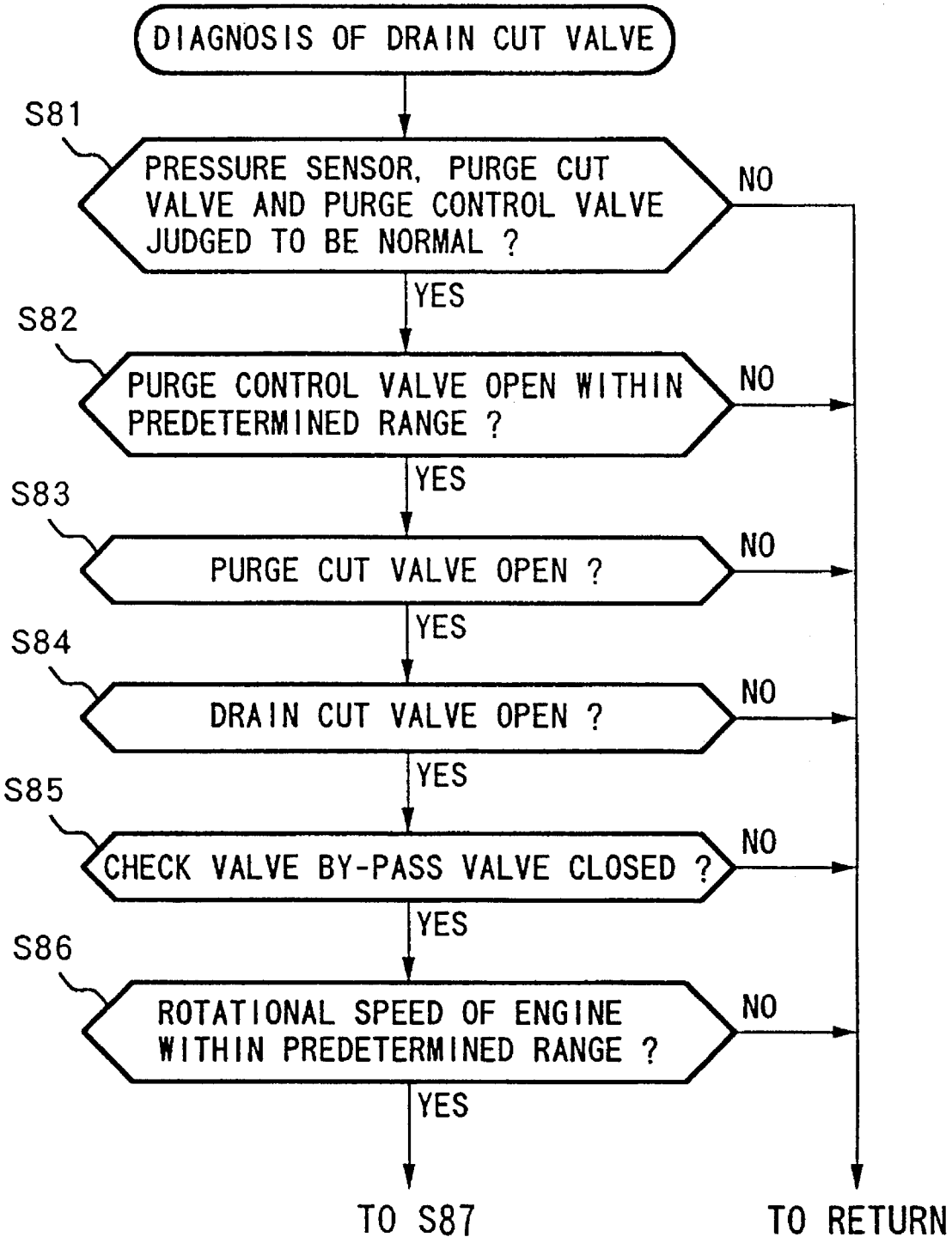
FIGS. 12A–B are a flow chart illustrating diagnosis of a drain cut valve.
Figure 12B:
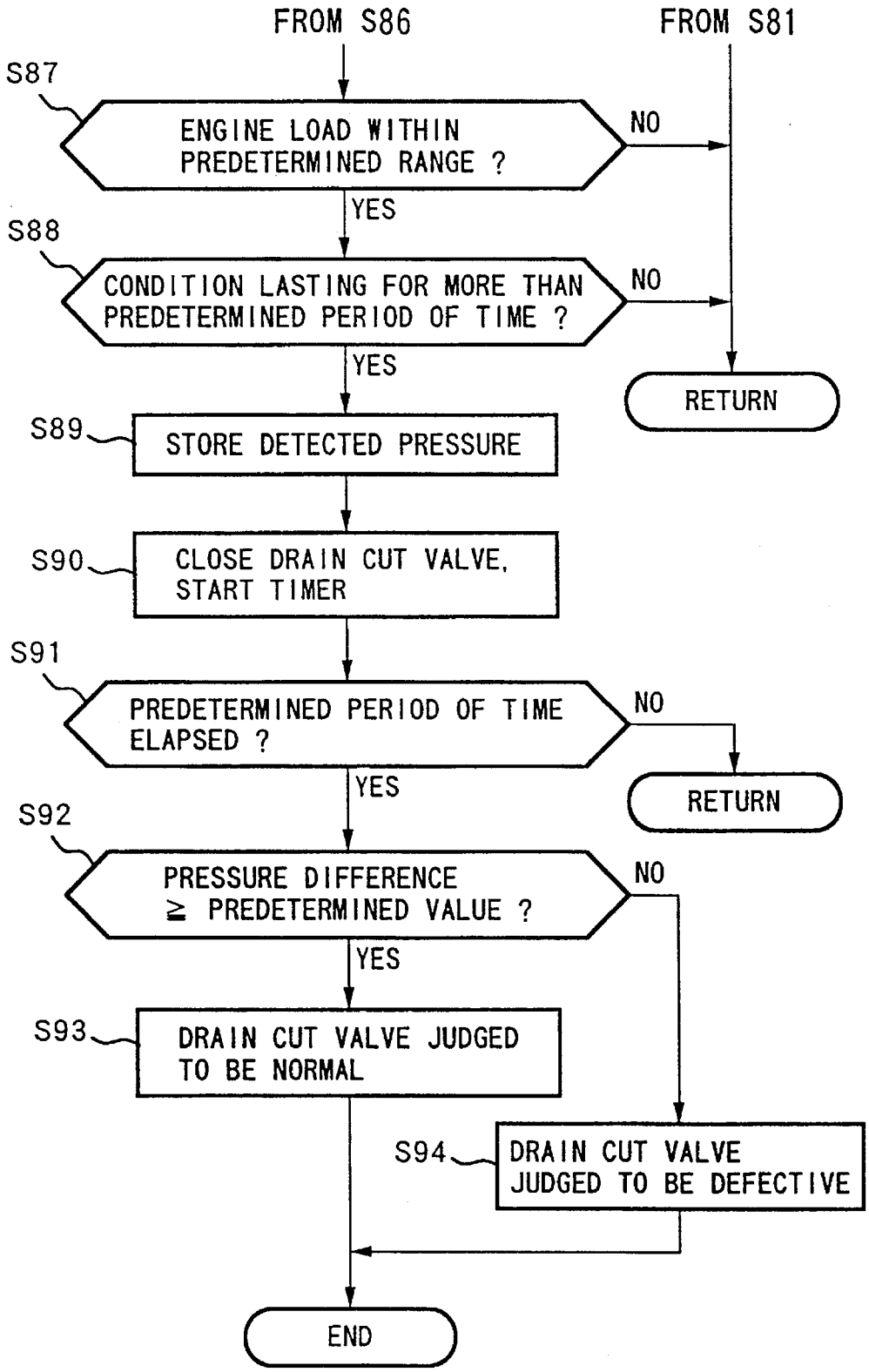

Next, described below with reference to a flow chart of FIG. 12 is the diagnosis control for the drain cut valve 9 represented by step S5 in the flow chart of FIG. 3.

In the flow chart of FIG. 12, it is judged at step S81 that the pressure sensor 7, the purge cut valve 13 and the purge control valve 14 are in the normal state based on the above-mentioned diagnosis control, and the program proceeds to step S82.

It is judged at step S82 if the purge control valve 14 is opened within a predetermined range. When it is opened within the predetermined range, the program proceeds to steps S83 to S85.

At steps S83 to S85, it is judged if the purge cut valve 13 is open, the drain cut valve 9 is open and the check valve by-pass valve 6 is closed.

When these valves are opened or closed as described above, it is judged at step S86 if the rotational speed Ne of the engine is within a predetermined range. It is further judged at step S87 if the engine load is within a predetermined range to specify the operation conditions of the engine for diagnosis.

When it is judged that the engine is operating under predetermined conditions, it is confirmed at step S88 that the conditions of steps S82 to S87 are lasting for more than a predetermined period of time.

When these conditions are lasting for more than a predetermined period of time, the program proceeds to step S89 where the pressure detected by the pressure sensor 7 is stored.

At step S90, the drain cut valve 9 is closed, and a timer is started to measure the lapse of time from the closure of the drain cut valve 9.

At step S91, it is judged whether the time measured by the timer started at the step S90 has exceeded a predetermined period of time or not, and the program proceeds to step S92 at a moment when the predetermined period of time has passed.

It is judged at step 92 whether a difference between the pressure stored at step S89 and the pressure detected at present by the pressure sensor 7 is equal to or greater than a predetermined value or not.

Figure 13:
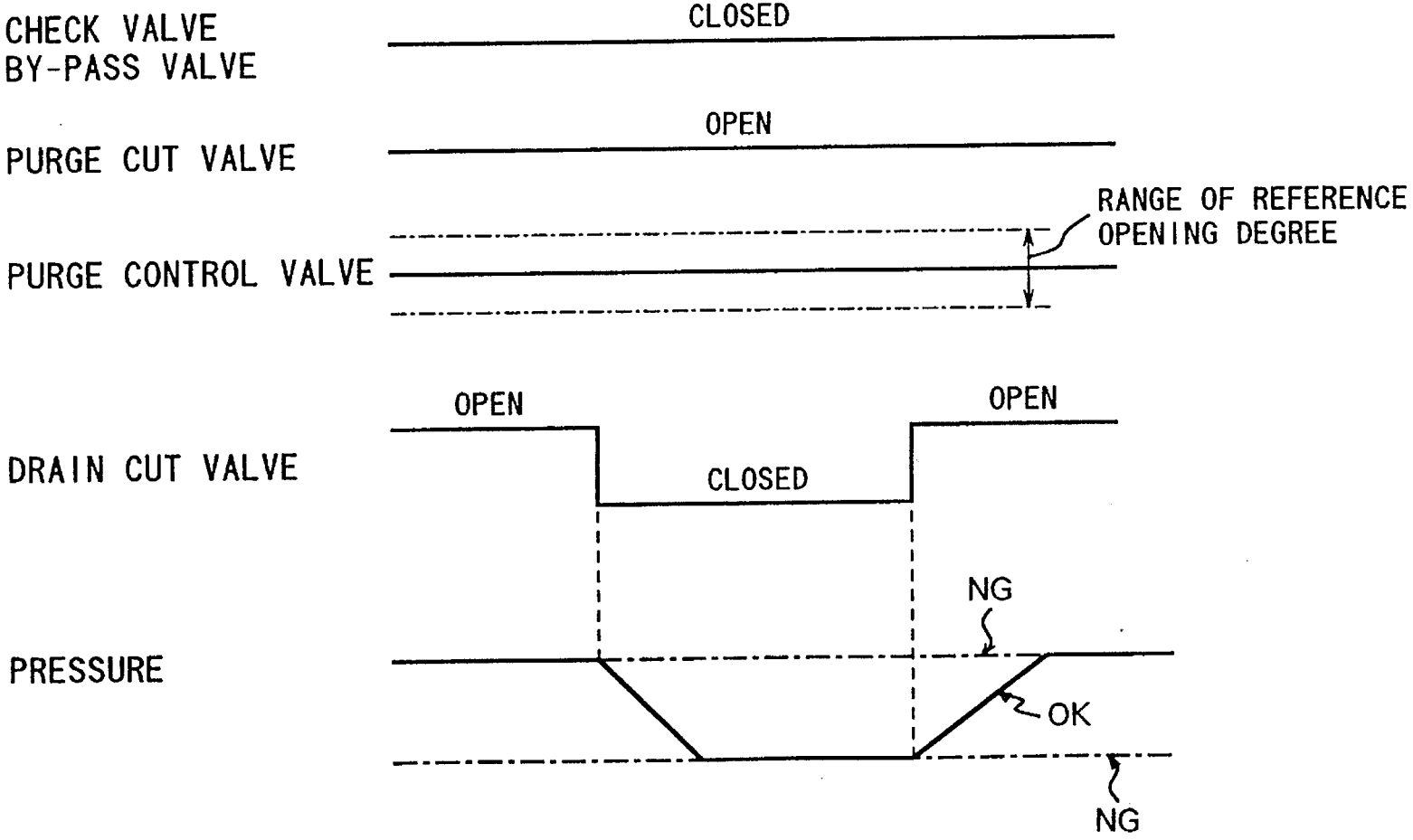
FIG. 13 is a time chart illustrating diagnostic characteristics of the drain cut valve.

The pressure detected by the pressure sensor 7 will drop (see FIG. 13) when the drain cut valve 9 is closed in the state where the intake negative pressure of the engine has been introduced. When the pressure does not drop, however, it is presumed that the drain cut valve 9 has not opened or closed as controlled.

When it is judged at step S92 that the pressure difference is equal to or greater than a predetermined value, the program proceeds to step S93 where it is judged that the drain cut valve 9 is normal. When it is judged at step S92 that the pressure difference is smaller than the predetermined value, however, it means that the pressure did not change to meet the opening or closing operation of the drain cut valve 9. It is therefore presumed that the drain cut valve 9 is not really opened or closed as controlled, and the program proceeds to step S94 where it is judged that the drain cut valve 9 is defective.

In the above-mentioned embodiment, the drain cut valve 9 is diagnosed based upon a pressure drop after the drain cut valve 9 is closed with the state where the drain cut valve 9 is open as a reference. It is, however, also allowable to diagnose the drain cut valve 9 based upon a rise in the pressure after the drain cut valve 9 is opened with the state where the drain cut valve 9 is closed as a reference.

Figure 14A:
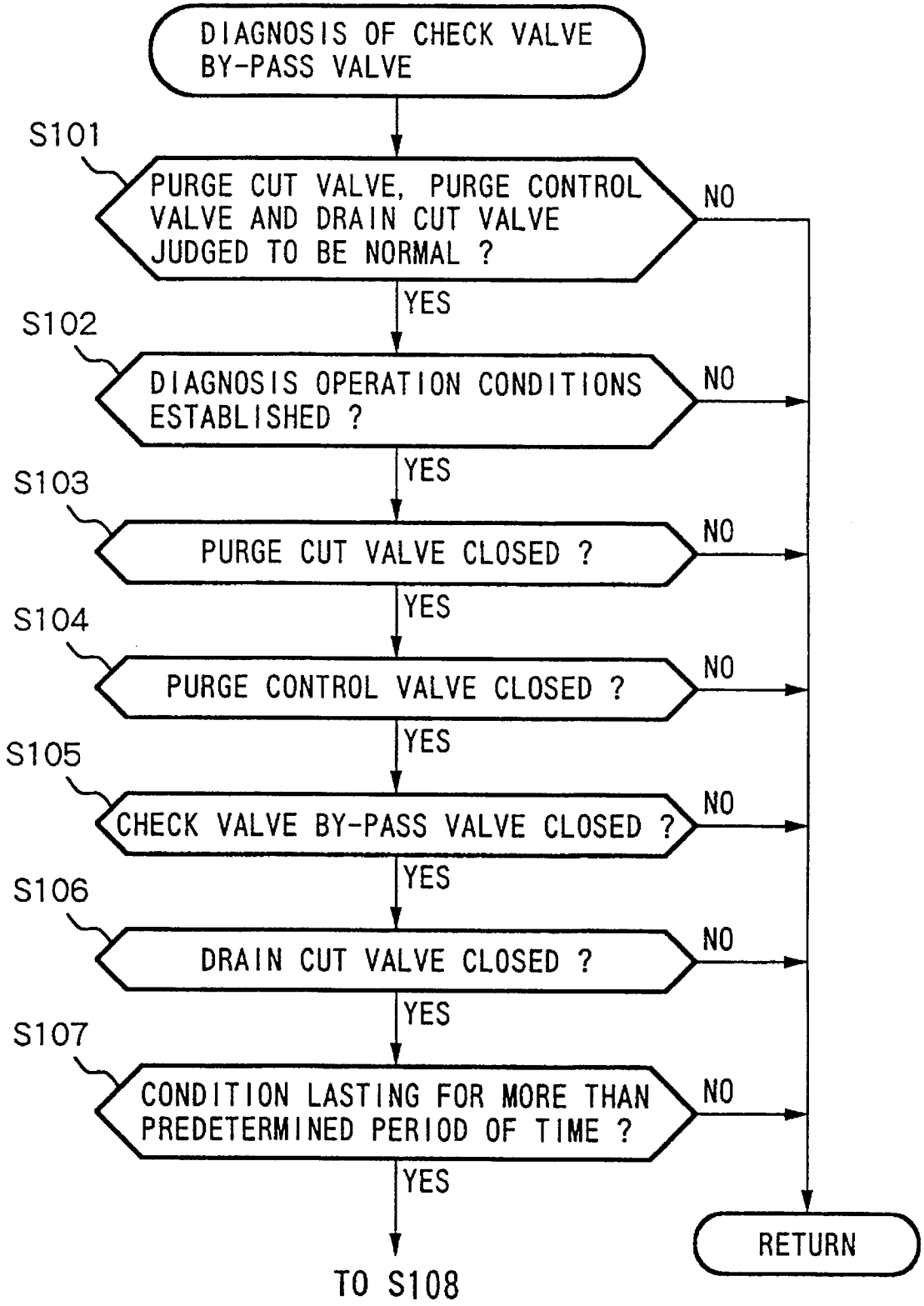
FIGS. 14A–B are a flow chart illustrating diagnosis of a check valve by-pass valve.
Figure 14B:
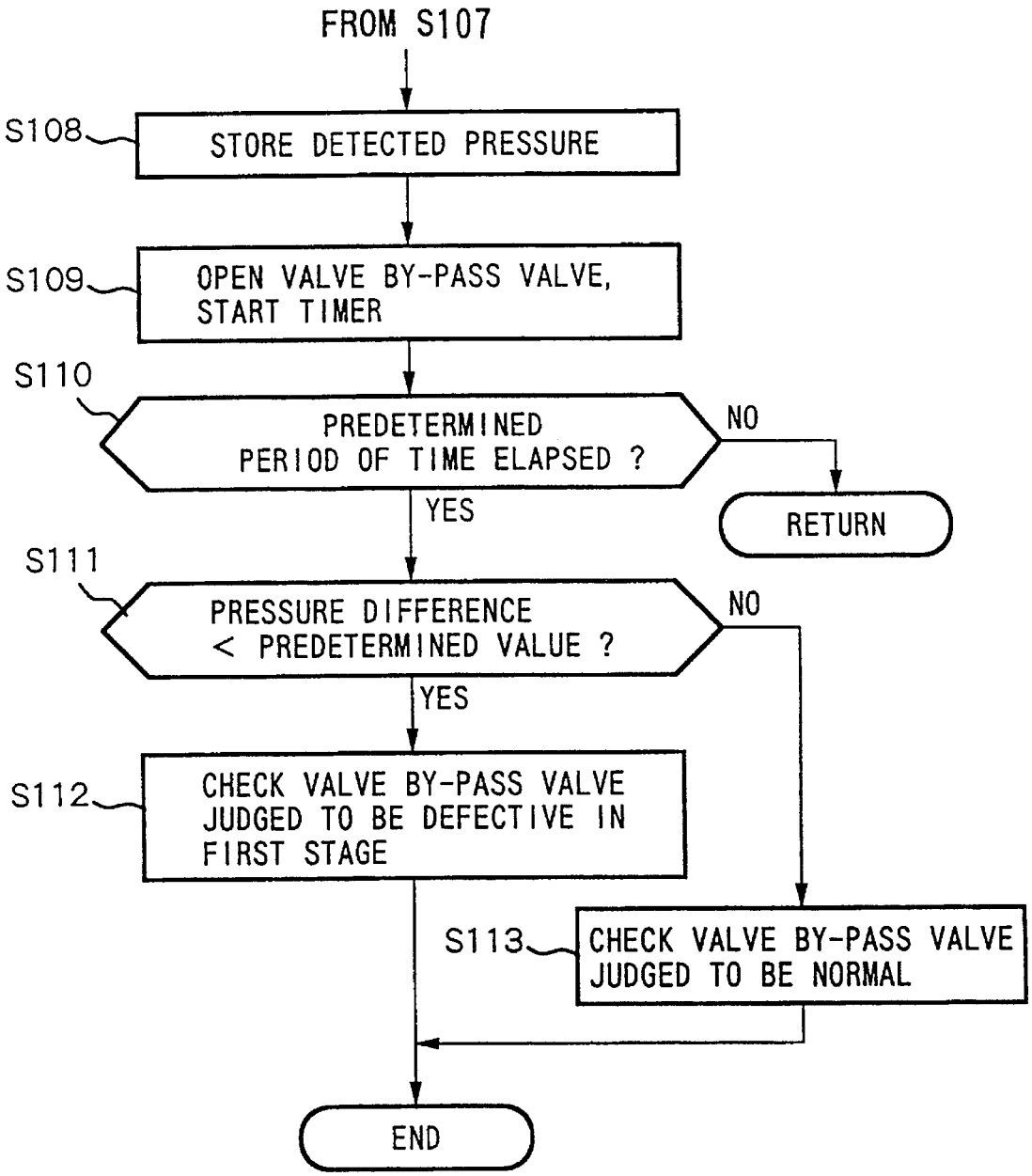

Next, described below with reference to a flow chart of FIG. 14 is a first diagnosis control for the check valve by-pass valve 6 represented by step S6 in the flow chart of FIG. 3.

Referring to the flow chart of FIG. 14, it is judged at step S101 that the purge cut valve 13, the purge control valve 14 and the drain cut valve 9 are normal and it is judged at next step S102 that the engine is under predetermined operation conditions as a prerequisite for the diagnosis control.

When the conditions for diagnosis are established, it is judged at steps S103 to S106 if the purge cut valve 13 is closed, the purge control valve 14 is closed, the check valve by-pass valve 6 is closed and the drain cut valve 9 is closed.

Under the above-mentioned closed conditions, it is judged at step S107 whether the above closed conditions are lasting for more than a predetermined period of time. At a moment when the above-mentioned closed conditions have lasted for the predetermined period of time, the pressure detected at that moment by the pressure sensor 7 is stored at step 108.

At next step S109, the check valve by-pass valve 6 is opened, and the timer is started to measure the lapse of time from when the check valve by-pass valve 6 is opened.

At step S110, it is judged, based upon the time measured by the timer, whether the time has passed for more than the predetermined period of time after the check valve by-pass valve 6 was opened. When the predetermined period of time has passed, the program proceeds to step S111 where it is judged whether a difference between the pressure stored when the check valve by-pass valve 6 was opened and the pressure detected at the present moment is smaller than a predetermined value or not.

When the check valve by-pass valve 6 is opened, the pressure will rise due to vaporization of the fuel in the fuel tank. When a pressure difference due to the rise in the pressure is not recognized at step S111, it is presumed that the check valve by-pass valve 6 is locked at its open position or closed position, and the program proceeds to step S112 where the check valve by-pass valve 6 is judged to be defective in a first stage.

When a rise in the pressure expected at step S111 is recognized as a result of the occurrence of a pressure difference which is equal to or larger than the above-mentioned predetermined value, it is so judged that the check valve by-pass valve 6 is really opening or closing as controlled, and the program proceeds to step S113 where it is judged that the check valve by-pass valve 6 is normal.

When the check valve by-pass valve 6 is judged to be defective at step S112, the second diagnosis control is carried out for the check valve by-pass valve 6 as represented by step S7 in the flow chart of FIG. 3. The second diagnosis control will now be described in detail with reference to the flow charts of FIGS. 15 to 17.

Figure 15A:
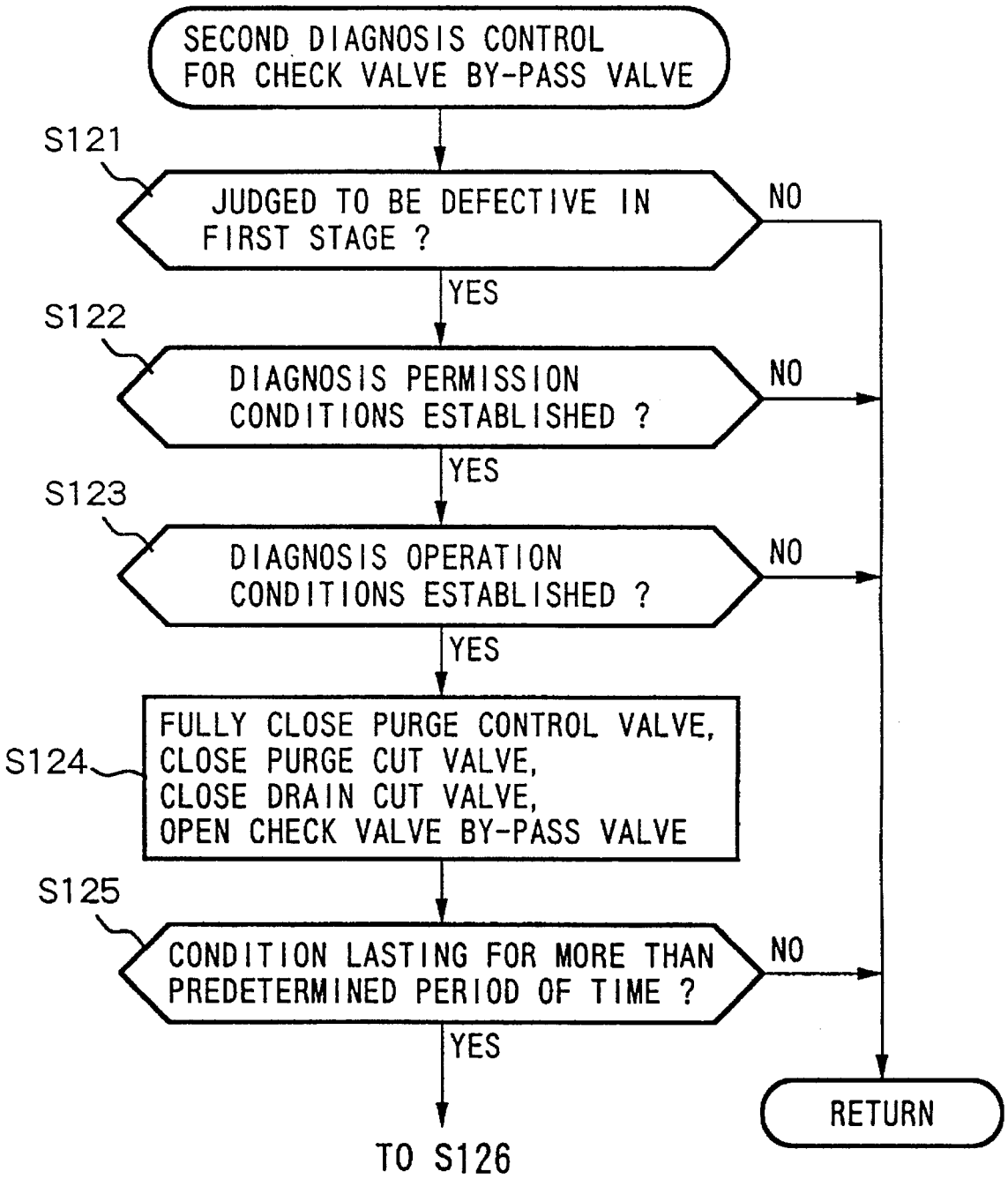
FIGS. 15A–B are a flow chart illustrating diagnosis of the check valve by-pass valve.
Figure 15B:
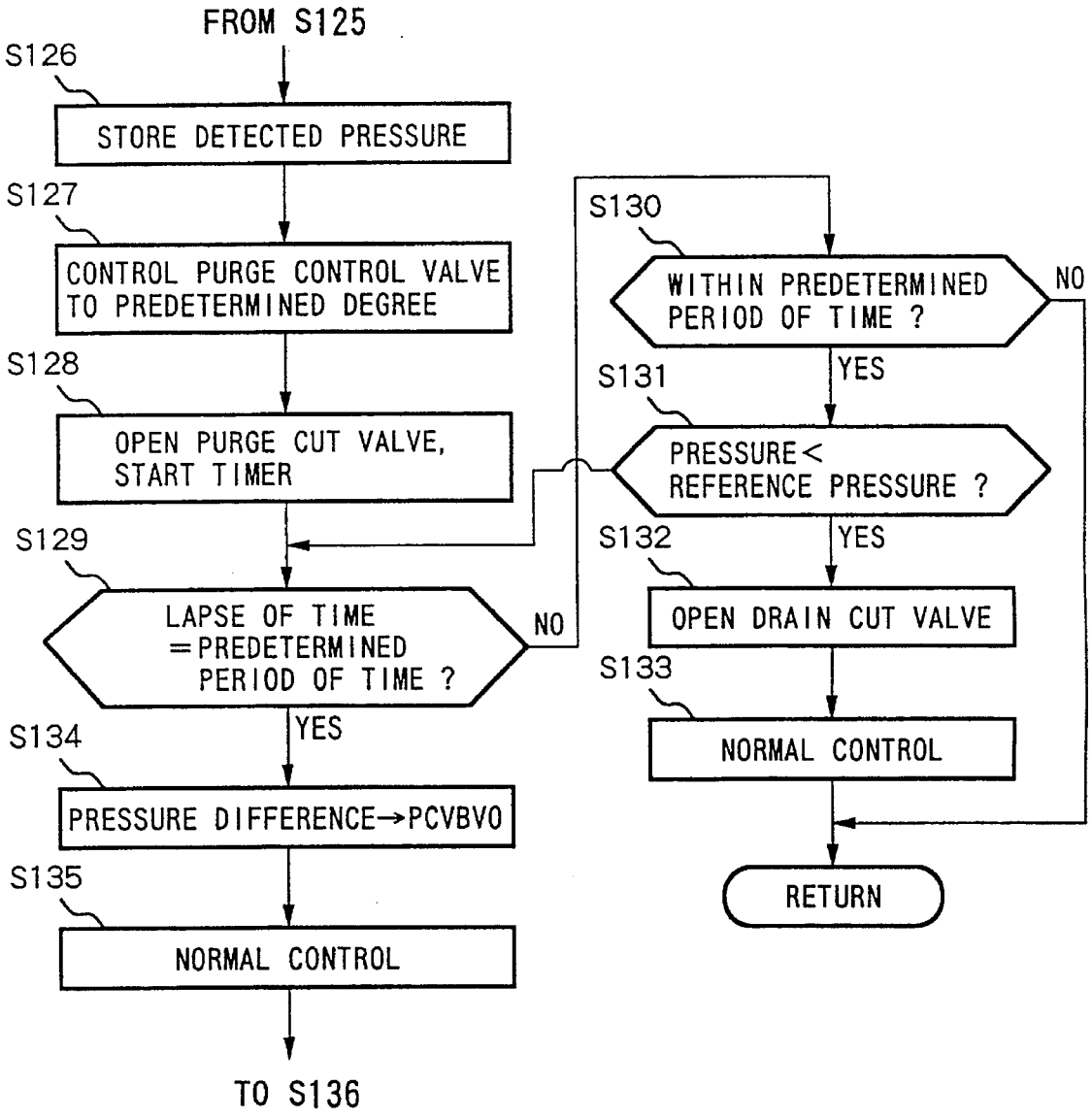
Figure 16A:
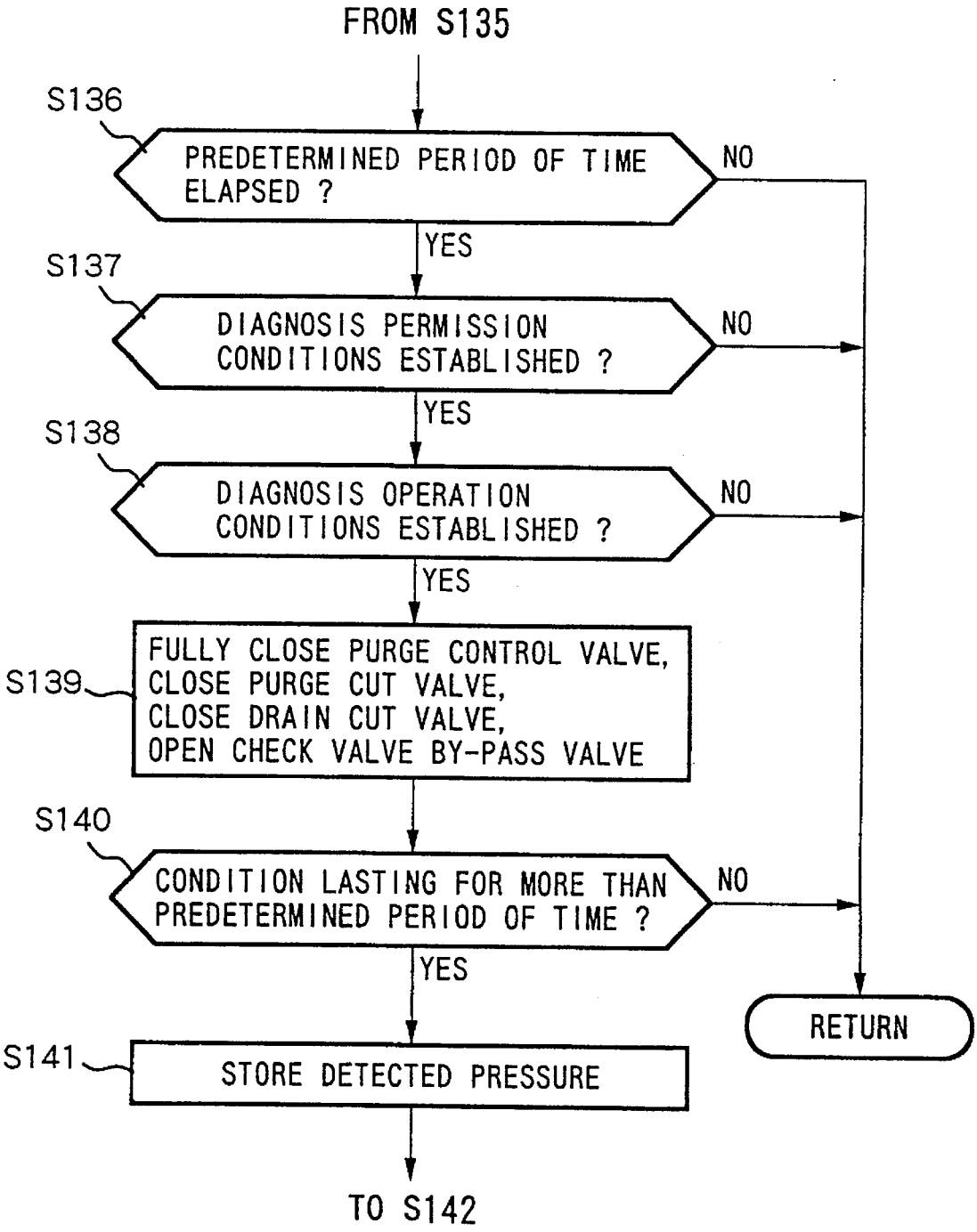
FIGS. 16A–B are a flow chart illustrating diagnosis of the check valve by-pass valve continued from FIG. 15.
Figure 16B:
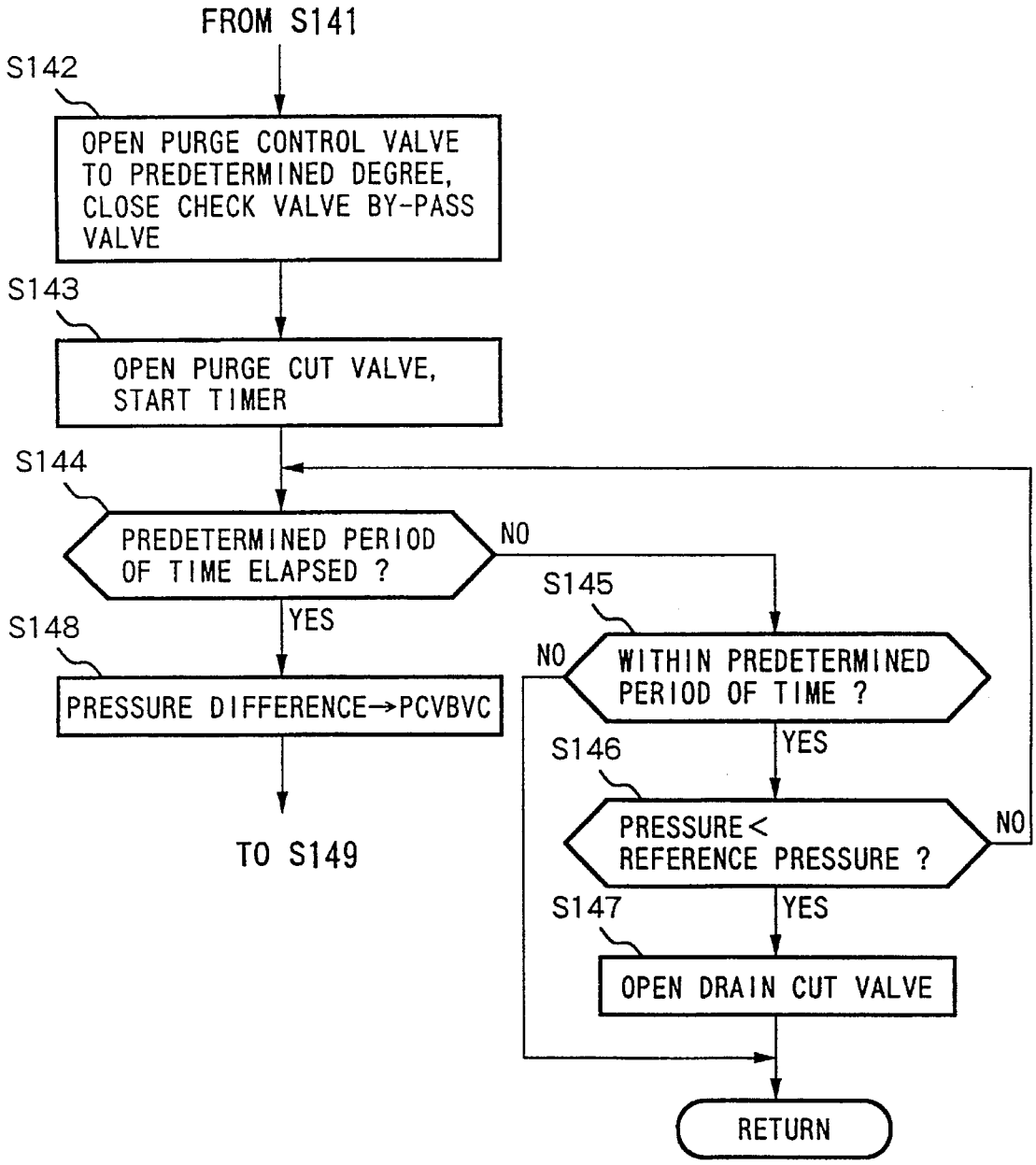
Figure 17:
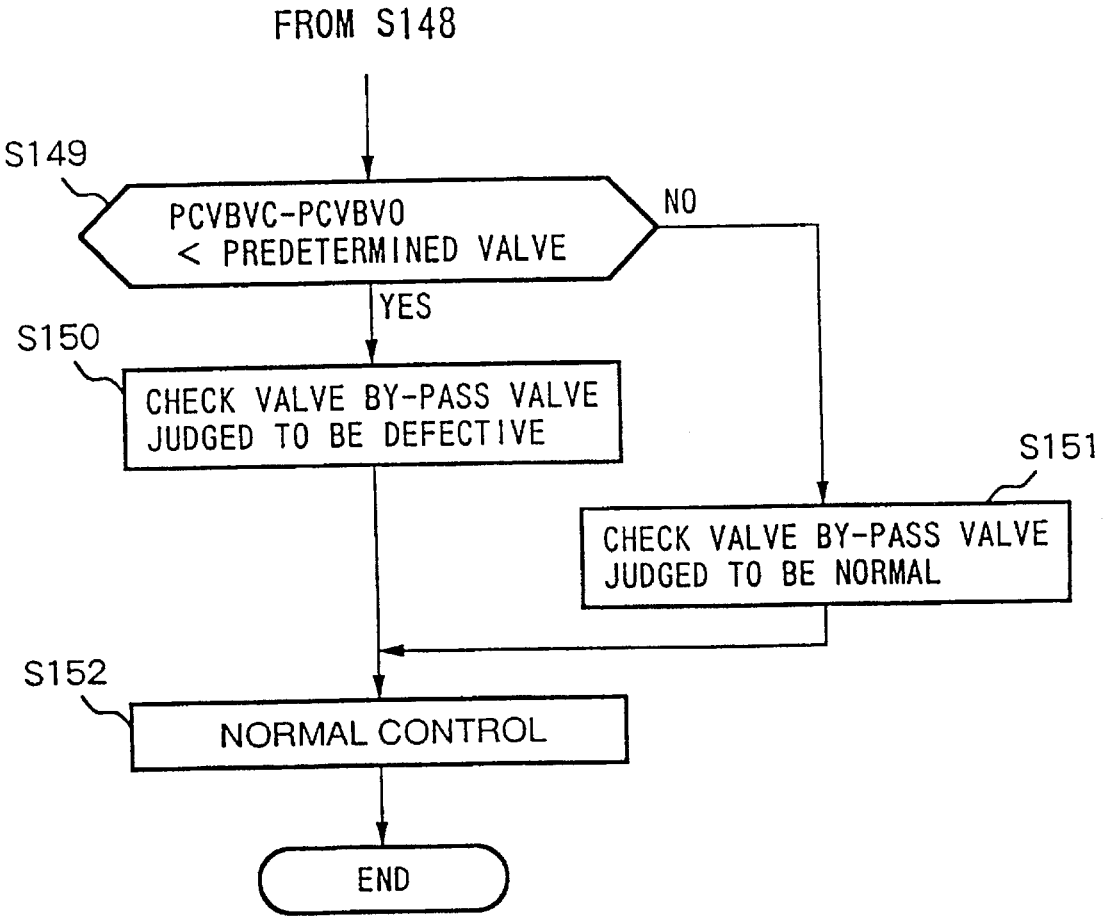
FIG. 17 is a flow chart illustrating diagnosis of the check valve by-pass valve continued from FIG. 16.

Referring to the flow charts of FIGS. 15 to 17, it judged at step S121 if the check valve by-pass valve 6 was judged to be defective in the first diagnosis control. When it was judged to be defective, the program proceeds to step S122 where it is judged whether the conditions for diagnosis are holding such as whether other valves are normal or not, and it is judged at step S123 whether the engine is under the operating conditions for diagnosis.

When the conditions for diagnosis are established, the program proceeds to step S124 where the purge control valve 14 is fully closed, the purge cut valve is closed, the drain cut valve 9 is closed and the check valve by-pass valve 6 is opened.

After it is judged at step S125 that the above-mentioned open or closed conditions are lasting for more than a predetermined period of time, the pressure detected at that moment by the pressure sensor 7 is stored at step S126.

At next step S127, the purge control valve 14 is opened to a predetermined degree and, then, at step S128, the purge cut valve 13 is opened and a timer is started to measure the lapse of time from the opening control thereof.

At step S129, it is judged whether the time measured by the timer that was started when the purge cut valve 13 was opened has reached a predetermined period of time. When the time measured does not correspond to the predetermined period of time, the program proceeds to step S130 where it is judged whether the time measured is prior to the lapse of the above predetermined period of time has passed or not. When the predetermined period of time, the program proceeds to step S131 where it is judged whether the pressure drops in excess of an allowable level.

When the pressure drops in excess of the allowable level, the program proceeds to step S132 where the drain cut valve 9 is opened to introduce the air in order to avoid excess of negative pressure. The program then proceeds to step S133 where normal control operation is executed without effecting the diagnosis.

When the predetermined period of time passes in a state where the pressure does not drop in excess of the allowable level, the program proceeds to step S134 from step S129, in order to calculate a difference between the pressure that was stored when the purge cut valve 13 was opened and the pressure detected at that moment, i.e., to calculate a pressure drop PCVBVO. The program then proceeds to step S135 to return to the normal control operation.

At step S136, it is judged whether the predetermined period of time has passed from a moment when the lapse of the predetermined period of time was recognized at step S129 and the drop of pressure was calculated.

When the predetermined period of time has passed, diagnosing conditions are judged at step S137 in the same manner as in the above-mentioned step S122, and the engine operating conditions are judged at step S138 in the same manner as that of step S123.

As the diagnosing conditions are established, the program proceeds to step S139 where the purge control valve 14 is fully closed, the purge cut valve 13 is closed, the drain cut valve 9 is closed and the check by-pass valve 6 is opened.

At step S140, it is judged that the above-mentioned open or closed conditions are lasting for more than a predetermined period of time. After these conditions have lasted for more than the predetermined period of time, the pressure detected at that moment by the pressure sensor 7 is stored at step S141.

At next step S142, the purge control valve 14 is opened to a predetermined degree, and the check valve by-pass valve 6 is closed.

At step S143, the purge cut valve 9 is opened, and a timer is started from zero in synchronism with the timing for opening the purge cut valve 9.

In the diagnosis executed at steps S124 to S134, the intake negative pressure of the engine was introduced under a condition where the check valve by-pass valve 6 was opened and a pressure drop within the predetermined period of time was sampled. In the diagnosis of steps S139 to S143, however, the intake negative pressure of the engine is introduced under a condition where the check valve by-pass valve 6 is closed and the pressure drop thereafter is detected.

After the purge cut valve 9 is opened at step S143, lapse of the predetermined period of time is judged at step S144 in the same manner as described earlier. When a pressure drop in excess of the allowable level is detected (S146) before the predetermined period of time has passed (S145), the drain cut valve 9 is opened so that the pressure drops no more (S147), and the program is returned to normal control operation.

On the other hand, when the predetermined period of time passes in a state where the pressure drop does not exceed the allowable level, a difference is calculated between the pressure stored at step S141 and the pressure detected at that moment, i.e., a pressure drop PCVBVC is calculated.

Figure 18:
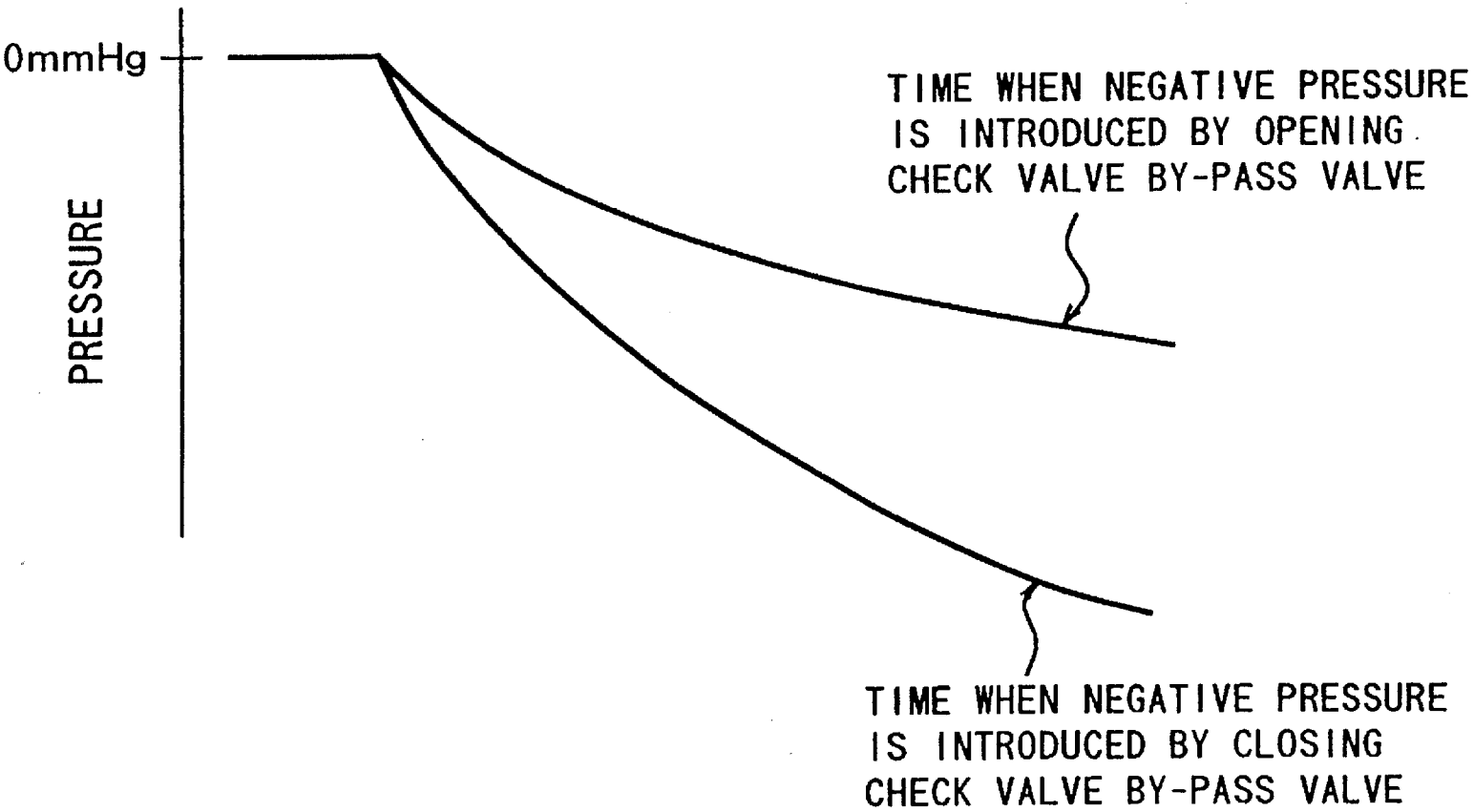
FIG. 18 is a time chart illustrating diagnostic characteristics of the check valve by-pass valve.

That is, a pressure drop PCVBVO due to the introduction of an intake negative pressure of the engine in a state where the check valve by-pass valve 6 is opened and a pressure drop PCVBVC due to the introduction of an intake negative pressure of the engine in a state where the check valve by-pass valve 6 is closed, are sampled by the above-mentioned control operation (see FIG. 18).

At step S149, it is judged whether a deviation (←PCVBVC-PCVBVO) in the pressure drop is smaller than a predetermined value or not. That is, when the check valve by-pass valve 6 is really opening and closing as controlled, the pressure drop that has occurred in a state where the check valve by-pass valve 6 is closed will become greater. Therefore, when the pressure drop does not much differ irrespective of the opening or closing of the check valve by-pass valve 6, it is presumed that the check valve by-pass valve 6 has been locked to its open position or closed position.

When it is judged at step S149 that a deviation (←PCVBVC-PCVBVO) in the pressure drop is smaller than the predetermined value, it is judged that the check valve by-pass valve 6 is defective and the check valve by-pass valve 6 is finally judged to be defective at step S150.

On the other hand, when it is judged at step S149 that a deviation (←PCVBVC-PCVBVO) in the voltage drop is equal to or larger than the predetermined value, it is so judged that the check valve by-pass valve 6 is really opening and closing as controlled, and the pressure has dropped by an amount in excess of the predetermined value. The program therefore proceeds to step S151 where the check valve by-pass valve 6 is judged to be normal.

After the check valve by-pass valve 6 is diagnosed, the program is shifted to normal control operation at step S152.

I claim:

1. A diagnosis apparatus in an apparatus for treating fuel vapor of an engine in which the fuel vapor in a fuel tank is adsorbed and trapped by an adsorbing means via a fuel vapor passage, and the fuel vapor adsorbed and trapped by the adsorbing means is supplied, via a purge passage, to an intake system of the engine together with the fresh air introduced through an air introduction passage utilizing an intake negative pressure of the engine, including a check valve provided in the fuel vapor passage, a check valve by-pass valve provided in a by-pass passage which by-passes the check valve, a drain cut valve provided in the air introduction passage, a purge cut valve which is opened and closed in an ON/OFF manner and a purge control valve of which degree is adjusted, interposed in series in the purge passage, and a pressure detecting means provided to detect pressure in the fuel vapor passage between the combination of the purge cut valve and the purge control valve and the combination of the check valve and the check valve by-pass valve, said apparatus comprising:

a valve defect diagnosis means for carrying out diagnosis for each of said check valve by-pass valve, said drain cut valve, said purge cut valve and said purge control valve based upon the comparison of reference pressure conditions depending on combinations of open and closed states of said check valve by-pass valve, said drain cut valve, said purge cut valve and said purge control valve with pressures detected by said pressure detecting means.

2. A diagnosis apparatus in an apparatus for treating fuel vapor of an engine according to claim 1, wherein a pressure detection defect diagnosis means for judging said pressure detecting means to be defective when the pressure detected by said pressure detecting means does not correspond to the atmospheric pressure in a state where said check valve by-pass valve is closed and at least one of said purge cut valve and said purge control valve is closed and said drain cut valve is opened, and said respective valves are diagnosed by said valve defect diagnosis means after it is judged by said pressure detection defect diagnosis means that said pressure detecting means is not defective.

3. A diagnosis apparatus in an apparatus for treating fuel vapor of an engine according to claim 1, wherein said valve defect diagnosis means judges said purge cut valve to be defective when a pressure detected by said pressure detecting means is equal to or lower than a reference pressure in a state where said check valve by-pass valve, said drain cut valve and said purge cut valve are closed and said purge control valve is opened to a predetermine degree.

4. A diagnosis apparatus in an apparatus for treating fuel vapor of an engine according to claim 1, wherein said valve defect diagnosis means judges said purge control valve to be defective when a pressure detected by said pressure detecting means is equal to or smaller than a reference pressure in a state where said check valve by-pass valve is closed, said drain cut valve and said purge cut valve are opened and said purge control valve is opened to a predetermined degree.

5. A diagnosis apparatus in an apparatus for treating fuel vapor of an engine according to claim 1, wherein said valve defect diagnosis means opens and closes said drain cut valve when said check valve by-pass valve is closed, said purge cut valve is opened and said purge control valve is opened to a predetermined degree, and judges said drain cut valve to be defective when a change in the pressure detected by said pressure detecting means accompanying opening and closing of said drain cut valve is equal to or smaller than a reference pressure.

6. A diagnosis apparatus in an apparatus for treating fuel vapor of an engine according to claim 1, wherein said valve defect diagnosis means opens said check valve by-pass valve when at least one of said purge cut valve and said purge control valve is closed and said drain cut valve is closed, and judges said check valve by-pass valve to be defective when a pressure detected at this moment by said pressure detecting means is equal to or smaller than a reference pressure.

7. A diagnosis apparatus in an apparatus for treating fuel vapor of an engine according to claim 1, wherein said valve defect diagnosis means judges said check valve bypass valve to be defective when a deviation between a pressure detected by said pressure detecting means in a state where said drain cut valve is closed, said check valve by-pass valve and said purge cut valve are opened and said purge control valve is opened to a predetermined degree and a pressure detected by said pressure detecting means in a state where said drain cut valve and said check valve by-pass valve are closed and said purge cut valve is opened to a predetermined degree is equal to or smaller than a reference value.

8. A diagnosis apparatus in an apparatus for treating fuel vapor of an engine according to claim 1, further comprising a first system defect diagnosis means which judges said apparatus for treating fuel vapor to be defective when a state where a pressure detected by said pressure detecting means is equal to or greater than a reference pressure has lasted for more than a predetermined period of time in a state where said purge cut valve is judged to be not defective, said check valve by-pass valve is closed, said purge cut valve and said drain cut valve are opened, and said purge control valve is opened to a predetermined degree.

9. A diagnosis apparatus in an apparatus for treating fuel vapor of an engine according to claim 1, further comprising a second-system defect diagnosis means which judges said apparatus for treating fuel vapor to be defective when a pressure detected by said pressure detecting means does not approach near the atmospheric pressure within a predetermined period of time in a state where said purge cut valve is judged to be not defective, said check valve by-pass is closed, said purge cut valve and said drain cut valve are opened, said purge control valve is opened to a predetermined degree, and said purge cut valve only is closed in a state where the pressure detected by said pressure detecting means is smaller than a reference pressure.

10. A diagnosis method in an apparatus for treating fuel vapor of an engine in which the fuel vapor in a fuel tank is adsorbed and trapped by an adsorbing means via a fuel vapor passage, and the fuel vapor adsorbed and trapped by the adsorbing means is supplied, via a purge passage, to an intake system of the engine together with the fresh air introduced through an air introduction passage utilizing an intake negative pressure of the engine, including a check valve provided in the fuel vapor passage, a check valve by-pass valve provided in a by-pass passage which by-passes the check valve, a drain cut valve provided in the air introduction passage, a purge cut valve which is opened and closed in an ON/OFF manner and a purge control valve of which degree is adjusted, interposed in series in the purge passage, and a pressure detecting means provided to detect pressure in the fuel vapor passage between the combination of the purge cut valve and the purge control valve and the combination of the check valve and the check valve by-pass valve, said method characterized in that defect diagnosis is carried out for each of said check valve by-pass valve, said drain cut valve, said purge cut valve and said purge control valve based upon the comparison of reference pressure conditions expected depending on combinations of open and closed states of said check valve by-pass valve, drain cut valve, said purge cut valve and purge control valve with pressures detected by said pressure detecting means.

11. A diagnosis method in an apparatus for treating fuel vapor of an engine according to claim 10, wherein said pressure detecting means is judged to be defective when a pressure detected by said pressure detecting means does not correspond to the atmospheric pressure in a state where said check valve by-pass valve is closed and at least one of said purge cut valve and said purge control valve is closed and said drain cut valve is opened, and said respective valves are diagnosed on condition that said pressure detecting means is judged to be not defective.

12. A diagnosis method in an apparatus for treating fuel vapor of an engine according to claim 10, wherein said said purge cut valve is judged to be defective when a pressure detected by said pressure detecting means is equal to or lower than a reference pressure in a state where said check valve by-pass valve, said drain cut valve and said purge cut valve are closed, and said purge control valve is opened to a predetermined degree.

13. A diagnosis method in an apparatus for treating fuel vapor of an engine according to claim 10, wherein said purge control valve is judged to be defective when a pressure detected by said pressure detecting means is equal to or smaller than a reference pressure in a state where said check valve by-pass valve is closed, said drain cut valve and said purge cut valve are opened, and said purge control valve is opened to a predetermined degree.

14. A diagnosis method in an apparatus for treating fuel vapor of an engine according to claim 10, wherein said drain cut valve is opened and closed when said check valve by-pass valve is closed, said purge cut valve is opened and said purge control valve is opened to a predetermined degree, and said drain cut valve is judged to be defective when a change in the pressure detected by said pressure detecting means accompanying opening and closing of said drain cut valve is equal to or smaller than a reference pressure.

15. A diagnosis method in an apparatus for treating fuel vapor of an engine according to claim 10, wherein said check valve by-pass valve is opened when at least one of said purge cut valve and said purge control valve is closed and said drain cut valve are closed, and said check valve by-pass valve is judged to be defective when a pressure detected at this moment by said pressure detecting means is equal to or smaller than a reference pressure.

16. A diagnosis method in an apparatus for treating fuel vapor of an engine according to claim 10, wherein said check valve by-pass valve is judged to be defective when a deviation between a pressure detected by said pressure detecting means in a state where said drain cut valve is closed, said check valve by-pass valve and said purge cut valve are opened and said purge control valve is opened to a predetermined degree and a pressure detected by said pressure detecting means in a state where said drain cut valve and said valve by-pass valve are closed and said purge cut valve is opened to a predetermined degree is equal to or smaller than a reference value.

17. A diagnosis method in an apparatus for treating fuel vapor of an engine according to claim 10, said apparatus for treating fuel vapor is judged to be defective when a state where a pressure detected by said pressure detecting means is equal to or greater than a reference pressure has lasted for more than a predetermined period of time in a state where said purge cut valve is judged to be not defective, said check valve by-pass valve is closed, said purge cut valve and said drain cut valve are opened, and said purge control valve is opened to a predetermined degree.

18. A diagnosis method in an apparatus for treating fuel vapor of an engine according to claim 10, said apparatus for treating fuel vapor is judged to be defective when a pressure detected by said pressure detecting means does not approach near the atmospheric pressure within a predetermined period of time in a state where said purge cut valve is judged to be not defective, said check valve by-pass valve is closed, said purge cut valve and said drain cut valve are opened, said purge control valve is opened to a predetermined degree, and said purge cut valve only is closed in a state where a pressure detected by said pressure detecting means is smaller than a reference pressure.

* * * * *